US010885841B2

(12) United States Patent
Kho

(10) Patent No.: US 10,885,841 B2
(45) Date of Patent: Jan. 5, 2021

(54) DISPLAY APPARATUS FOR VEHICLE

(71) Applicant: LG ELECTRONICS INC., Seoul (KR)

(72) Inventor: Taeho Kho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/714,306

(22) Filed: Dec. 13, 2019

(65) Prior Publication Data

US 2020/0193904 A1 Jun. 18, 2020

(30) Foreign Application Priority Data

Dec. 13, 2018 (WO) ..... PCT/KR2018/015838

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2310/08* (2013.01); *G09G 2320/0233* (2013.01); *G09G 2320/041* (2013.01); *G09G 2320/045* (2013.01); *G09G 2320/046* (2013.01); *G09G 2320/064* (2013.01); *G09G 2380/10* (2013.01)

(58) Field of Classification Search
CPC ..... G09G 3/3233; G09G 2310/061; G09G 2310/08; G09G 2320/0233; G09G 2320/0285; G09G 2320/041; G09G 2320/045; G09G 2320/046; G09G 2320/0626; G09G 2320/064; G09G 2380/10; G09G 3/3266; G09G 3/327; G09G 3/2096; G09G 3/3677; G09G 2300/0408; G09G 2300/0871; G09G 2310/0291; G09G 2310/45475; H01L 27/3211; H01L 27/3244; H01L 27/1225; H03F 3/195; H03F 3/3022; H03F 3/45183; H03F 3/45192; H03F 3/45219; H03F 3/45475; H03F 3/68; H03F 2203/45652; H04L 25/0278; H04L 25/0298

See application file for complete search history.

(56) References Cited

U.S. PATENT DOCUMENTS

2018/0061307 A1* 3/2018 Inoue ..... G09G 3/3275
2019/0156746 A1* 5/2019 Kim ..... G09G 3/3233

* cited by examiner

*Primary Examiner* — Nelson M Rosario
(74) *Attorney, Agent, or Firm* — Fish & Richardson P.C.

(57) ABSTRACT

A display apparatus for a vehicle includes: an organic light emitting panel; a gray level calculating unit configured to calculate a gray level of the organic light emitting panel; a temperature detecting unit configured to detect a temperature of the organic light emitting panel; and a processor configured to divide the organic light emitting panel into a plurality of blocks, divide the plurality of blocks into a plurality of sub-blocks smaller than the plurality of blocks, calculate a luminance reduction amount per unit time of the plurality of sub-blocks, based on gray level information of the sub-block calculated by the gray level calculating unit and temperature information of the organic light emitting panel detected by the temperature detecting unit, and calculate a time point of degradation compensation of the organic light emitting panel, based on the luminance reduction amount per unit time of the plurality of sub-blocks.

20 Claims, 14 Drawing Sheets

DISPLAY APPARATUS FOR VEHICLE

CROSS-REFERENCE TO RELATED APPLICATIONS

This application claims benefit to International Application No. PCT/KR2018/015838, filed on Dec. 13, 2018. The disclosures of the prior applications are incorporated by reference in their entirety.

BACKGROUND OF THE INVENTION

1. Field of the invention

The present invention relates to a display apparatus for vehicle, and more particularly, to a display apparatus for vehicle which may accurately and quickly calculate a time point at which a burn-in phenomenon occurs in the display apparatus for vehicle having an organic light emitting panel.

2. Description of the Related Art

A vehicle is an apparatus that is moved in a direction desired by a boarding user. Typically, an automobile is an example of the vehicle.

Meanwhile, for the convenience of a user who uses the vehicle, various sensors and electronic devices are provided. In particular, various devices for the convenience of the user are being developed.

As the vehicle is equipped with various electronic devices, various comfort equipment or systems are mounted in the vehicle.

In addition, there is a display apparatus for vehicle which is provided in the vehicle, and is able to output various kinds of information related to the travel of the vehicle and various contents for the convenience of a passenger.

In recent years, there have been increasing cases of adopting an organic light emitting panel having a high response speed and a clear image quality to the display apparatus for vehicle.

However, in the organic light emitting panel, a burn-in phenomenon occurs due to the characteristics of the device, and accordingly, various methods for reducing the burn-in phenomenon have been studied.

SUMMARY OF THE INVENTION

The present invention has been made in view of the above problems, and provides a display apparatus for vehicle which may more accurately and quickly calculate the burn-in phenomenon of an organic light emitting panel.

In accordance with an aspect of the present invention, a display apparatus for a vehicle includes: an organic light emitting panel; a gray level calculating unit configured to calculate a gray level of the organic light emitting panel; a temperature detecting unit configured to detect a temperature of the organic light emitting panel; and a processor configured to divide the organic light emitting panel into a plurality of blocks, divide the plurality of blocks into a plurality of sub-blocks smaller than the plurality of blocks, calculate a luminance reduction amount per unit time of the plurality of sub-blocks, based on gray level information of the sub-block calculated by the gray level calculating unit and temperature information of the organic light emitting panel detected by the temperature detecting unit, and calculate a time point of degradation compensation of the organic light emitting panel, based on the luminance reduction amount per unit time of the plurality of sub-blocks.

BRIEF DESCRIPTION OF THE DRAWINGS

The objects, features and advantages of the present invention will be more apparent from the following detailed description in conjunction with the accompanying drawings, in which.

DETAILED DESCRIPTION OF THE PREFERRED EMBODIMENTS

Hereinafter, the present invention will be described in detail with reference to the accompanying drawings. With respect to constituent elements used in the following description, suffixes "module" and "unit" are given only in consideration of ease in the preparation of the specification, and do not have or serve as different meanings. Accordingly, the suffixes "module" and "unit" may be used interchangeably.

A vehicle described in this specification may include an automobile, and a motorcycle. Hereinafter, the vehicle is described mainly based on the automobile.

The vehicle described in the present specification may include all of an internal combustion engine vehicle having an engine as a power source, a hybrid vehicle having an engine and an electric motor as a power source, an electric vehicle having an electric motor as a power source, and the like.

In the following description, the left side of vehicle means the left side in the traveling direction of vehicle, and the right side of vehicle means the right side in the traveling direction of vehicle.

Figure 1:
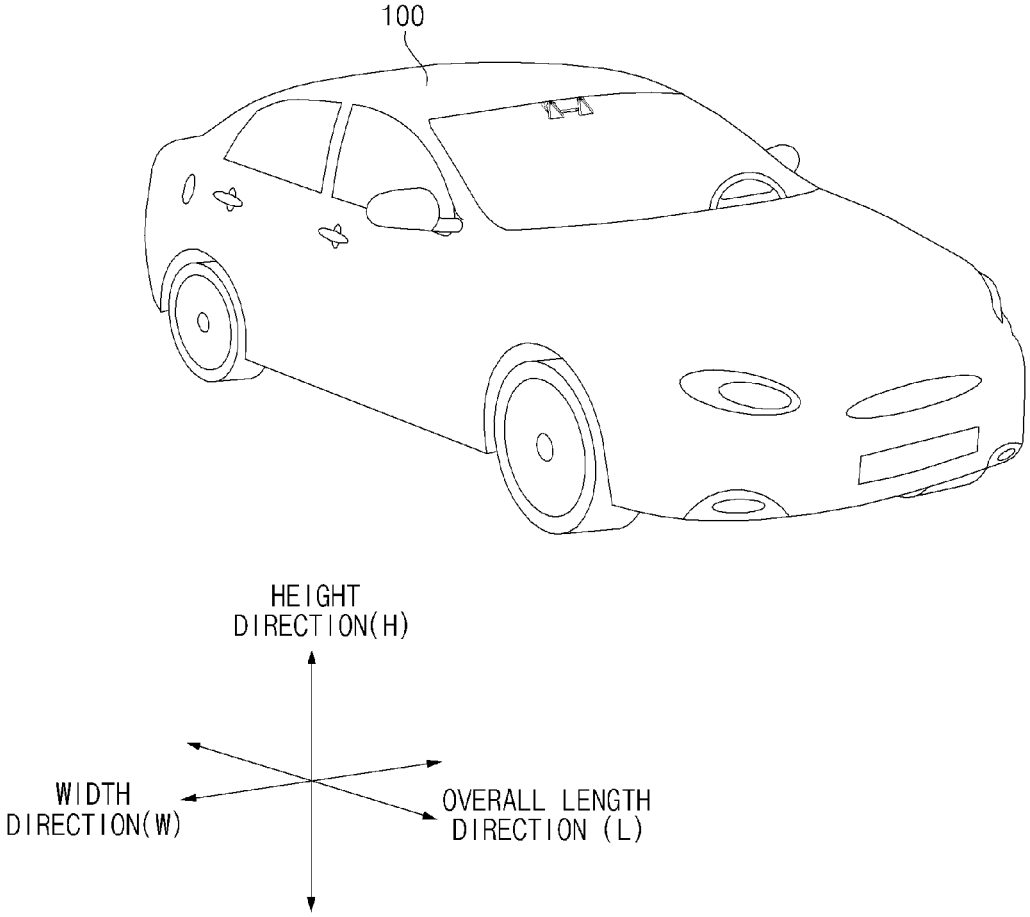
FIG. 1 is a diagram showing an exterior of a vehicle according to an embodiment of the present invention.

FIG. 1 is a diagram showing an exterior of a vehicle according to an embodiment of the present invention.

Referring to the drawings, a vehicle 100 may include a wheel rotated by a power source, and a steering input device for adjusting the traveling direction of the vehicle 100.

The vehicle 100 may include a display apparatus 200 for vehicle according to the present invention.

The display apparatus 200 for vehicle may be provided in the vehicle 100, and may output graphic objects indicating dashboard information of the vehicle 100 or various image contents. The display apparatus 200 for vehicle may be a cluster of the vehicle 100.

According to an embodiment, the vehicle 100 may be an autonomous vehicle. In the case of the autonomous vehicle, it may be switched to an autonomous travel mode or a manual mode according to user input. When it is switched to the manual mode, the autonomous vehicle 100 may receive a steering input through a steering input device.

The overall length means a length from the front portion of the vehicle 100 to the rear portion, the width means a breadth of the vehicle 100, and the height means a length from the bottom of the wheel to the roof. In the following description, it is assumed that the overall length direction L is a direction used as a reference for the measurement of the overall length of the vehicle 100, the width direction W is a direction used as a reference for the measurement of the width of the vehicle 100, and the height direction H is a direction used as a reference for the measurement of the height of the vehicle 100.

Figure 2:
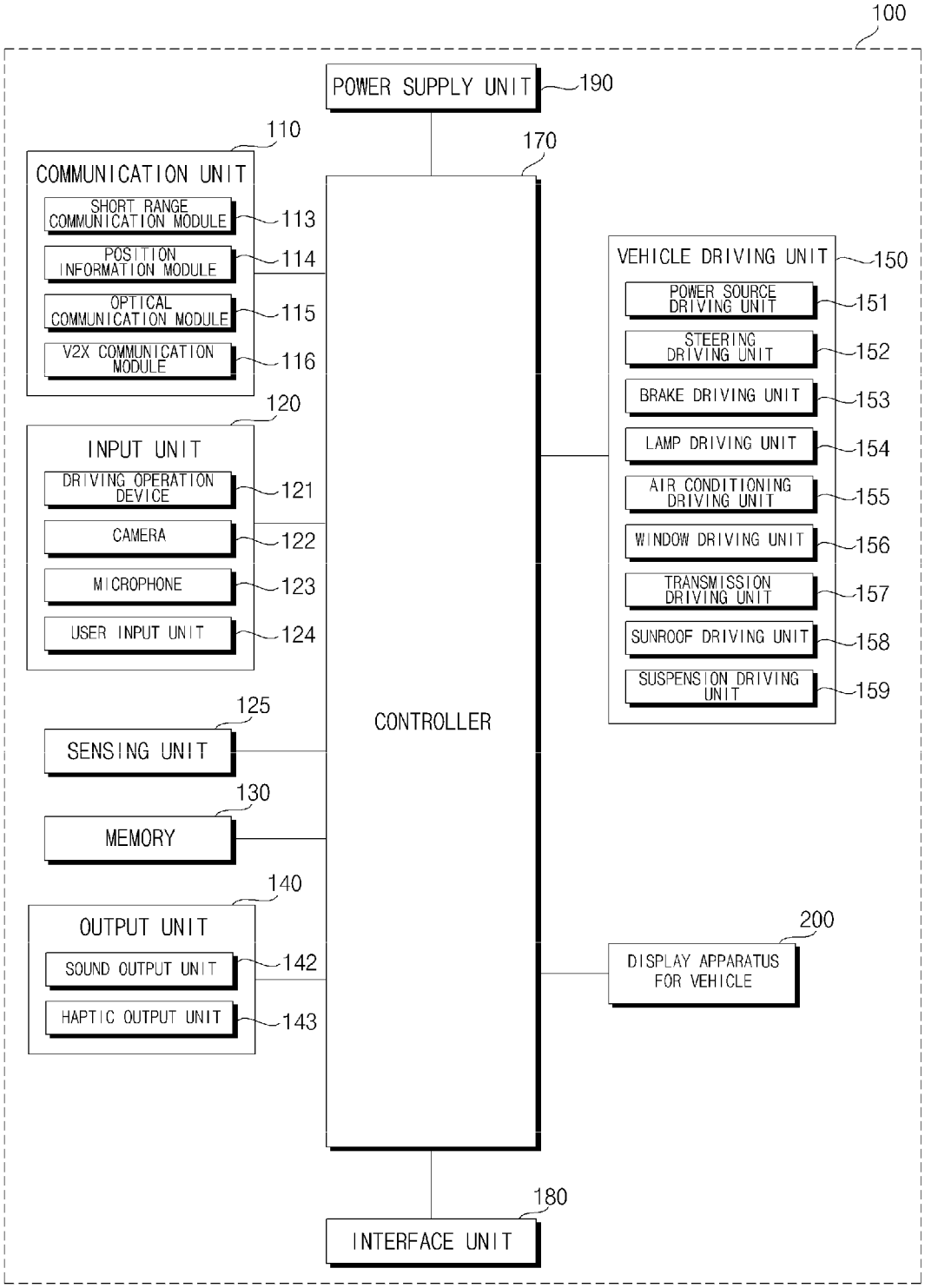
FIG. 2 is a block diagram for explaining a vehicle according to an embodiment of the present invention.

FIG. 2 is a block diagram for explaining a vehicle according to an embodiment of the present invention.

Referring to the drawing, the vehicle 100 may include a communication unit 110, an input unit 120, a sensing unit 125, a memory 130, an output unit 140, a vehicle driving unit 150, a controller 170, an interface unit 180, a power supply unit 190, and a display apparatus 200 for vehicle.

The communication unit 110 may include a short range communication module 113, a position information module 114, an optical communication module 115, and a V2X communication module 116.

The short range communication module 113 is used to achieve short range communication, and may support a short range communication by using at least one of a Bluetooth™, a Radio Frequency Identification (RFID), an Infrared Data Association (IrDA), a Ultra Wideband (UWB), a Near Field Communication (NFC), Wireless-Fidelity (Wi-Fi), Wi-Fi Direct, and Wireless Universal Serial Bus (Wireless USB).

The short range communication module 113 may form a wireless local area network to perform short range communication between the vehicle 100 and at least one external device. For example, the short range communication module 113 may exchange data with a mobile terminal wirelessly. The short range communication module 113 may receive weather information and road traffic situation information (e.g., Transport Protocol Expert Group (TPEG)) from the mobile terminal. For example, when user is boarding the vehicle 100, the user's mobile terminal and the vehicle 100 may perform pairing with each other automatically or by application execution of the user.

The position information module 114 is a module for obtaining the position of the vehicle 100, and a representative example thereof is a Global Positioning System (GPS) module. For example, when the vehicle utilizes the GPS module, it may obtain the position of the vehicle by using a signal sent from a GPS satellite.

Meanwhile, according to an embodiment, the position information module 114 may be a component included in the sensing unit 125, not a component included in the communication unit 110.

The optical communication module 115 may include a light emitting unit and a light receiving unit.

The light receiving unit may convert the light signal into an electric signal and receive the information. The light receiving unit may include a photodiode (PD) for receiving light. The photodiode may convert light into an electrical signal. For example, the light receiving unit may receive information of forward vehicle through a light emitted from a light source included in a forward vehicle.

The light emitting unit may include at least one light emitting element for converting an electric signal into an optical signal. Here, the light emitting element is preferably a light emitting diode (LED). The light emitting unit may convert the electrical signal into the optical signal and transmit it to the outside. For example, the light emitting unit may emit the optical signal to the outside through the blinking of the light emitting element corresponding to a certain frequency. According to an embodiment, the light emitting unit may include a plurality of light emitting element arrays. According to an embodiment, the light emitting unit may be integrated with a lamp provided in the vehicle 100. For example, the light emitting unit may be at least one of a headlight, a tail light, a brake light, a turn signal light, and a side light. For example, the optical communication module 115 may exchange data with other vehicle through optical communication.

The V2X communication module 116 is a module for performing wireless communication with a server or other vehicle. The V2X module 116 includes a module capable of implementing inter-vehicle communication (V2V) or vehicle-to-infrastructure communication (V2I) protocols. The vehicle 100 may perform wireless communication with an external server and other vehicle through the V2X communication module 116.

The input unit 120 may include a driving operation device 121, a microphone 123, and a user input unit 124. The driving operation device 121 receives a user input for driving the vehicle 100. The driving operation device 121 may include a steering input device, a shift input device, an acceleration input device, and a brake input device.

The steering input device receives a progress direction input of the vehicle 100 from the user. The steering input device is preferably implemented in a form of wheel so that steering input can be performed by rotation. According to an embodiment, the steering input device may be formed of a touch screen, a touch pad, or a button.

The shift input device receives inputs of parking (P), forward (D) , neutral (N) , and reverse (R) of the vehicle 100 from the user. The shift input device is preferably implemented in a form of lever. According to an embodiment, the shift input device may be formed of a touch screen, a touch pad, or a button.

The acceleration input device receives an input for acceleration of the vehicle 100 from the user. The brake input device receives an input for deceleration of the vehicle 100 from the user. The acceleration input device and the brake input device are preferably implemented in a form of pedal. According to an embodiment, the acceleration input device or the brake input device may be formed of a touch screen, a touch pad, or a button.

The microphone 123 may process an external sound signal into electrical data. The processed data may be utilized variously according to the function being performed in the vehicle 100. The microphone 123 may convert the user's voice command into electrical data. The converted electrical data may be transmitted to the controller 170.

Meanwhile, according to an embodiment, the camera 122 or the microphone 123 may be a component included in the sensing unit 125, not a component included in the input unit 120.

The user input unit 124 is used to receive information from a user. When the information is input through the user input unit 124, the controller 170 may control the operation of the vehicle 100 to correspond to the input information. The user input unit 124 may include a touch type input means or a mechanical type input means. According to an embodiment, the user input unit 124 may be disposed in one area of the steering wheel. In this case, the user may operate the user input unit 124 by using his/her finger while holding the steering wheel.

The sensing unit 125 senses various situations of the vehicle 100 or an external situation of the vehicle. To this end, the sensing unit 125 may include a collision sensor, a wheel sensor, a speed sensor, a tilt sensor, a weight sensor, a heading sensor, a yaw sensor, a gyro sensor, a position sensor, a vehicle forward/reverse sensor, a battery sensor, a fuel sensor, a tire sensor, a steering sensor for a steering wheel rotation, a vehicle interior temperature sensor, a vehicle interior humidity sensor, an ultrasonic sensor, an illumination sensor, an accelerator pedal position sensor, a brake pedal position sensor, and the like.

The sensing unit 125 may obtain a sensing signal based on vehicle collision information, vehicle direction information, vehicle position information (GPS information), vehicle angle information, vehicle speed information, vehicle acceleration information, vehicle tilt information, vehicle forward/reverse information, battery information, fuel information, tire information, vehicle lamp information, vehicle interior temperature information, vehicle interior humidity information, steering wheel rotation angle, vehicle exterior illumination, a pressure applied to the accelerator pedal, a pressure applied to the brake pedal, and the like.

The sensing unit 125 may further include an accelerator pedal sensor, a pressure sensor, an engine speed sensor, an air flow sensor (AFS), an air temperature sensor (ATS), a water temperature sensor WTS, a throttle position sensor (TPS), a TDC sensor, a crank angle sensor (CAS), and the like.

Meanwhile, the position information module 114 may be classified as a sub component of the sensing unit 125.

The sensing unit 125 may include an object sensing unit for sensing an object around the vehicle. Here, the object sensing unit may include a camera module, a radar, a lidar, and an ultrasonic sensor. In this case, the sensing unit 125 may sense a front object positioned in the front of the vehicle or a rear object positioned in the rear of the vehicle through the camera module, the radar, the lidar, or the ultrasonic sensor.

The sensing unit 125 may include a camera module. The camera module may include an outside camera module for photographing the outside of the vehicle and an inside camera module for photographing the inside of the vehicle.

The outside camera module may include one or more cameras that photograph the outside of the vehicle 100. The outside camera module may include an Around View Monitoring (AVM) device, a Blind Spot Detection (BSD) device, or a rear camera device.

The AVM device may synthesize a plurality of images obtained from a plurality of cameras and provide a vehicle around image to a user. The AVM device may synthesize a plurality of images and convert them into an image which is convenient for the user to watch. For example, the AVM device may synthesize a plurality of images and convert them into a top-view image.

For example, the AVM device may include first to fourth cameras. In this case, the first camera may be disposed around a front bumper, around a radiator grille, around an emblem, or around a windshield. The second camera may be disposed in a left side mirror, a left front door, a left rear door, and a left fender. The third camera may be disposed in a right side mirror, a right front door, a right rear door, or a right fender. The fourth camera may be disposed around a rear bumper, around the emblem, or around a license plate.

The BSD device detects an object from an image obtained from one or more cameras, and may output an alarm when it is determined that a possibility of collision with an object exists.

For example, the BSD device may include first and second cameras. In this case, the first camera may be disposed in the left side mirror, the left front door, the left rear door, or the left fender. The second camera may be disposed in the right side mirror, the right front door, the right rear door, or the right fender.

The rear camera may include a camera that obtains a vehicle rear image.

For example, the rear camera may be disposed around the rear bumper, around the emblem, or around the license plate.

The memory 130 is electrically connected to the controller 170. The memory 130 may store basic data for a unit, control data for controlling the operation of the unit, and input/output data. The memory 130 may be, in hardware, various storage devices such as ROM, RAM, EPROM, flash drive, hard drive, and the like. The memory 130 may store a program for processing or controlling the controller 170, and various data for the overall operation of the vehicle 100.

The output unit 140 is implemented to output information processed by the controller 170, and may include a sound output unit 142 and a haptic output unit 143.

The sound output unit 142 converts the electric signal transmitted from the controller 170 into an audio signal and outputs the audio signal. For this purpose, the sound output unit 142 may include a speaker, or the like. It is also possible for the sound output unit 142 to output a sound corresponding to the operation of the user input unit 724.

The haptic output unit 143 generates a tactile output. For example, the haptic output unit 143 may operate to vibrate a steering wheel, a seat belt, and a seat so that the user may recognize the output.

The vehicle driving unit 150 may control the operation of various devices of vehicle.

The vehicle driving unit 150 may include a power source driving unit 151, a steering driving unit 152, a brake driving unit 153, a lamp driving unit 154, an air conditioning driving unit 155, a window driving unit 156, a transmission driving unit 157, a sunroof driving unit 158, and a suspension driving unit 159.

The power source driving unit 151 may perform electronic control of a power source in the vehicle 100.

For example, when a fossil fuel-based engine (not shown) is a power source, the power source driving unit 151 may perform electronic control of the engine. Thus, the output torque of the engine, and the like may be controlled. When the power source driving unit 151 is an engine, the speed of the vehicle may be limited by limiting the engine output torque under the control of the controller 170.

As another example, when an electric-based motor (not shown) is a power source, the power source driving unit 151 may perform control of the motor. Thus, the rotation speed, torque, and the like of the motor may be controlled.

The steering driving unit 152 may perform electronic control of the steering apparatus in the vehicle 100. Thus, the traveling direction of the vehicle may be changed.

The brake driving unit 153 may perform electronic control of a brake apparatus (not shown) in the vehicle 100. For example, it is possible to reduce the speed of the vehicle 100 by controlling the operation of the brakes disposed in the wheel. As another example, it is possible to adjust the traveling direction of the vehicle 100 to the left or right by differently operating the brakes respectively disposed in the left wheel and the right wheel.

The lamp driving unit 154 may control the turn-on/turn-off of the lamps disposed inside and outside the vehicle. In addition, the intensity, direction, and the like of the light of the lamp may be controlled. For example, it is possible to perform control of a direction indicating lamp, a brake lamp, and the like.

The air conditioning driving unit 155 may perform electronic control for an air conditioner (not shown) in the vehicle 100. For example, when the temperature inside the vehicle is high, the air conditioner may be operated to control the cooling air to be supplied into the vehicle.

The window driving unit 156 may perform electronic control of a window apparatus in the vehicle 100. For example, it is possible to control the opening or closing of left and right windows in the lateral side of the vehicle.

The transmission driving unit 157 may perform electronic control of a gear apparatus of the vehicle 100. For example, in response to a signal from the controller 170, the transmission driving unit 157 may control the gear apparatus of the vehicle 100 to be positioned in a forward gear D, a reverse gear R, a neutral gear N, and a parking gear P.

The sunroof driving unit 158 may perform electronic control of a sunroof apparatus (not shown) in the vehicle 100. For example, the sunroof driving unit 158 may control the opening or closing of the sunroof.

The suspension driving unit 159 may perform electronic control of a suspension apparatus (not shown) in the vehicle 100. For example, when there is unevenness on the road surface, the suspension driving unit 159 may control the suspension apparatus to reduce the vibration of the vehicle 100.

Meanwhile, according to an embodiment, the vehicle driving unit 150 may include a chassis driving unit. Here, the chassis driving unit may include a steering driving unit 152, a brake driving unit 153, and a suspension driving unit 159.

The controller 170 may control the overall operation of each unit in the vehicle 100. The controller 170 may be referred to as an Electronic Control Unit (ECU).

The controller 170 may be implemented in hardware by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and other electronic unit for performing other functions.

The interface unit 180 may serve as a channel to various kinds of external devices connected to the vehicle 100. For example, the interface unit 180 may include a port that can be connected to a mobile terminal, and may be connected to the mobile terminal through the port. In this case, the interface unit 180 may exchange data with the mobile terminal.

Meanwhile, the interface unit 180 may serve as a channel for supplying electrical energy to the connected mobile terminal. When the mobile terminal is electrically connected to the interface unit 180, the interface unit 180 may provide the mobile terminal with electric energy supplied from a power supply unit 190 under the control of the controller 170.

The power supply unit 190 may supply power necessary for operation of respective components under the control of the controller 170. The controller 170 may receive power from a battery (not shown) or the like inside the vehicle.

The display apparatus 200 for vehicle is provided in the vehicle 100, and may output a graphic object indicating dashboard information of the vehicle 100 or various image contents.

Hereinafter, the display apparatus 200 for vehicle will be described in more detail.

Figure 3:
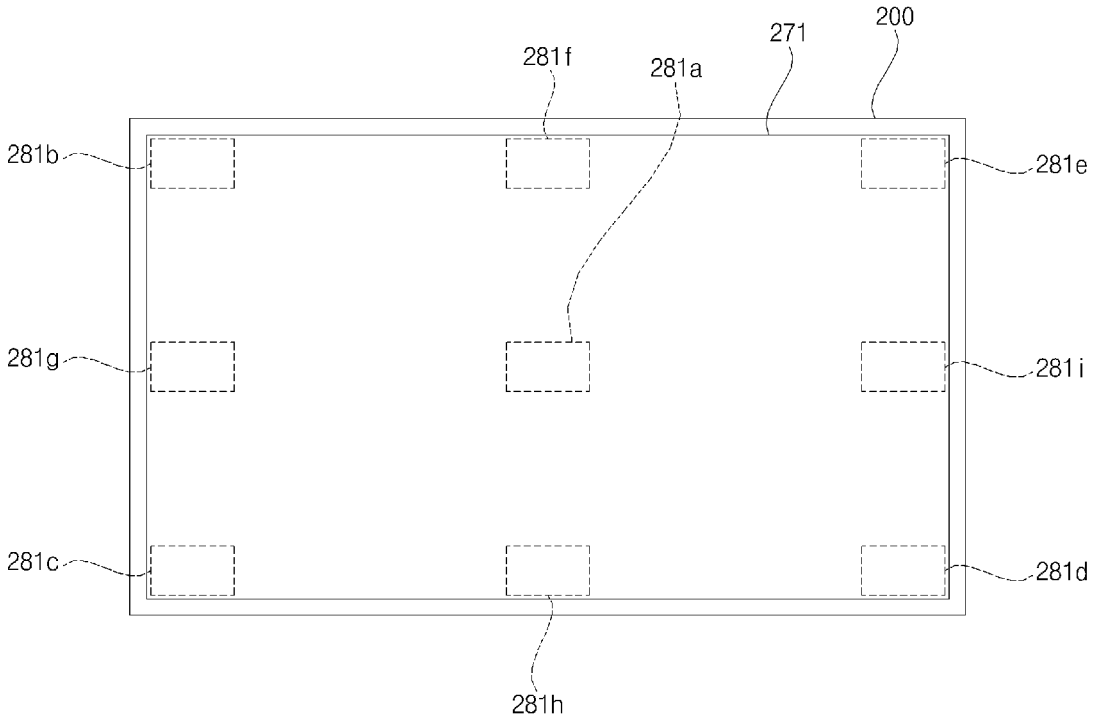
FIG. 3 is a diagram showing a display apparatus for vehicle according to an embodiment of the present invention.
Figure 4:
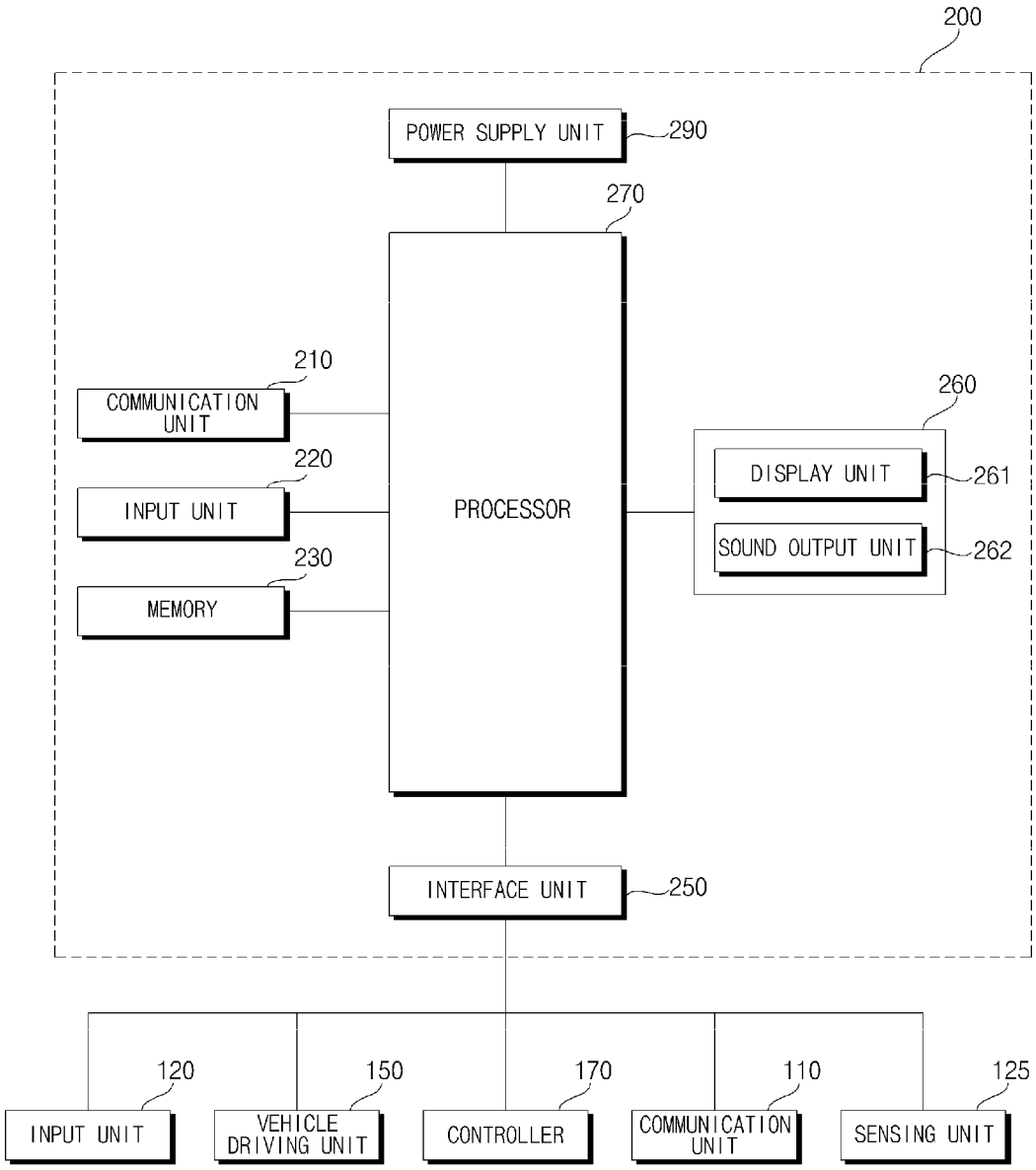
FIG. 4 is an internal block diagram of the display apparatus for vehicle of FIG. 2.

FIG. 3 is a diagram showing a display apparatus for vehicle according to an embodiment of the present invention, and FIG. 4 is an internal block diagram of the display apparatus for vehicle of FIG. 2.

Referring to the drawings, the display apparatus 200 for vehicle may include a communication unit 210, an input unit 220, a memory 230, an interface unit 250, an output unit 260, a processor 270, and a power supply unit 290.

The communication unit 210 may perform data communication with other device located inside or outside the vehicle 100. The other device may include at least one of a terminal, a mobile terminal, a server, and other vehicle.

The communication unit 210 may include at least one of a V2X communication module, an optical communication module, a position information module, and a short range communication module.

The input unit 220 may receive various inputs for the display apparatus 200 for vehicle. The input unit 220 may receive user's input for the display apparatus 200 for vehicle. When the ON input for the display apparatus 200 for vehicle is received through the input unit 220, the display apparatus 200 for vehicle may be operated.

The input unit 220 may be electrically connected to the processor 270. The input unit 220 may generate a signal corresponding to the received input and provide the signal to the processor 270. The processor 270 may control the display apparatus 200 for vehicle according to an input for the display apparatus 200 for vehicle received through the input unit 220.

The input unit 220 may receive an activation input for various functions of the display apparatus 200 for vehicle. For example, the input unit 220 may receive a setting input for an output mode of the output unit 260.

The input unit 220 may include at least one of a mechanical type input device, a touch type input device, and a wireless input device.

The mechanical type input device may include a button, a lever, a jog wheel, a switch, and the like.

The touch type input device may include at least one touch sensor. The touch input device may be formed of a touch screen.

In the case where a navigation is outputted to the touch screen, when a touch input for a specific point of the navigation is received, the processor 270 may generate and output a travel path for the vehicle 100 to travel to a specific point corresponding to the received touch input, or may control the vehicle 100 so that the vehicle 100 autonomously travels to the specific point.

The wireless input device may receive user input wirelessly.

The input unit 220 may include a camera (not shown) and a microphone (not shown). The camera may obtain image and generate image data. The microphone may generate sound data which is an electrical signal by using an input voice. The input unit 220 may provide the processor 270 with at least one of the generated image data and the sound data. The processor 270 may convert the image data and the sound data received through the input unit 220 into user's input for the display apparatus 200 for vehicle. For example, the processor 270 may perform a specific function of the display apparatus 200 for vehicle in response to a voice input through a microphone.

The memory 230 may store a program for processing or controlling the processor 270, various data of the operation of a multimedia device 200 for vehicle, and at least one content. The memory 230 may be electrically connected to the processor 270. The processor 270 may allow various data of the operation of the multimedia device 200 for vehicle to be stored in the memory 230. The processor 270 may output the content stored in the memory 230 to the output unit 260.

The memory 230 may store, in a lookup table format, the luminance reduction amount information of an organic light emitting panel 271 in accordance with the gray level change of the organic light emitting panel 271.

In addition, the memory 230 may store, in a lookup table format, the luminance reduction amount information of the organic light emitting panel 271 in accordance with the temperature change of the organic light emitting panel 271.

In particular, the memory 230 may store, in a lookup table format, the luminance reduction amount information of the organic light emitting panel 271 in accordance with the gray level change and temperature change of the organic light emitting panel 271.

At this time, the luminance reduction amount of the organic light emitting panel 271 in accordance with the gray level change and temperature change of the organic light emitting panel 271 may be derived by experiment.

The memory 230 may store first data as luminance reduction amount information per unit time of each of a plurality of sub-blocks and second data as accumulated luminance reduction amount information of each of the plurality of sub-blocks.

The memory 230 may initialize the first data after a lapse of a unit time under the control of the processor 270.

The memory 230 may be various storage devices such as a ROM, a RAM, an EPROM, a flash drive, a hard drive, and the like, in hardware. The memory 230 may be included as a sub-configuration of the processor 270, according to an embodiment.

The interface unit 250 may serve as a channel between the multimedia device 200 for vehicle and an external device. The interface unit 250 may receive various signals or information from the outside or may transmit signals or information provided by the processor 270 to the outside. The interface unit 250 may be connected to the processor 270, the input unit 120, the vehicle driving unit 150, the controller 170, the communication unit 110, and the sensing unit 125 to perform data communication.

The interface unit 250 transmits the driving information of the vehicle 100 provided from at least one of the input unit 120, the vehicle driving unit 150, the controller 170, the communication unit 110, and the sensing unit 125 to the processor 270.

The driving information may include information on at least one of a position of the vehicle 100, a traveling path, a speed, an autonomous travel state, a driving mode, a fuel amount, a charging amount, a vehicle type, a driving unit state, and a time. The driving mode may include an eco mode for travel based on fuel efficiency, a sports mode for sports travel, and a normal mode.

The interface unit 250 may provide a signal provided by the processor 270 to the controller 170 or the vehicle driving unit 150. The signal provided to the controller 170 or the vehicle driving unit 150 may be a signal for controlling the vehicle 100. The controller 170 may control the vehicle 100 in response to a signal for controlling the vehicle 100. The vehicle driving unit 150 may be driven in response to a signal for controlling the vehicle 100.

The output unit 260 may include a display unit 261 for outputting an image and a sound output unit 262 for outputting sound.

The display unit 261 may display various graphic objects.

The display unit 261 may include a liquid crystal display (LCD) panel and a thin film transistor-liquid crystal display (TFT LCD) panel.

More preferably, the display unit 261 may include an organic light-emitting diode (OLED) panel. As the display unit 261 includes the organic light emitting panel 271, a response speed of the image signal is improved, and the image quality becomes clear.

The display unit 261 may include one of a head up display (HUD), a cluster, and a center information display (CID).

The display unit 261 may include a cluster that allows a driving unit to check the travel information of the vehicle 100 or the state information of the vehicle 100. The cluster may be positioned on the dashboard. The driving unit may check information displayed in the cluster while maintaining the line of sight ahead of the vehicle 100.

The display unit 261 may be implemented as a head up display (HUD). When the display unit 261 is implemented as the HUD, information may be output through a transparent display provided in a windshield. Alternatively, the display unit 261 may include a projection module to output information through an image projected on the windshield.

The display unit 261 may include a transparent display. The transparent display may be formed on the front surface of the windshield. When the vehicle 100 is in the autonomous travel mode, an image included in the game content of the mobile terminal may be displayed on the front surface of the windshield. The image of the game content displayed on the windshield may be an augmented reality (AR) image.

The transparent display may display a certain screen while having a certain transparency. The transparent display may have a transparent organic light-emitting diode (OLED) to have transparency. The transparency of the transparent display may be adjusted.

Meanwhile, the display apparatus 200 for vehicle of the present invention may include a temperature detecting unit 280 for detecting the temperature of the organic light emitting panel 271.

The temperature detecting unit 280 may measure the temperature of the organic light emitting panel 271 in real time, and output a temperature signal which is an electrical signal to transmit to the processor 270. For example, the temperature detecting unit 280 may be a temperature sensor such as a thermistor whose resistance value varies depending on temperature.

The temperature detecting unit 280 may include a first temperature detecting unit 281*a* which is disposed in the center of the rear surface of the organic light emitting panel 271 and detects the center temperature the organic light emitting panel 271, a second temperature detecting unit 281*b* or 281*f*, a third temperature detecting unit 281*c* or 281*g*, a fourth temperature detecting unit 281*d* or 281*h*, and a fifth temperature detecting unit 281*e* or 281*i* which are disposed in the edge of the rear surface of the organic light emitting panel 271 and detect the temperature of the edge of the organic light emitting panel 271.

Here, the first temperature detecting unit 281*a* may be referred to as a center temperature detecting unit, and the second temperature detecting unit 281*b* or 281*f* to the fifth temperature detecting unit 281*e* or 281*i* may be referred to as an edge temperature detecting unit.

Meanwhile, according to an embodiment, the number of the edge temperature detecting unit may be increased or decreased, and the position of the edge temperature detecting unit may also be appropriately arranged in the edge area of the rear surface of the organic light emitting panel 271.

For example, as the size of the organic light emitting panel 271 becomes larger, the more edge temperature detecting units may be required.

Hereinafter, it is illustrated that the second temperature detecting unit 281*b* to the fifth temperature detecting unit 281*e* are disposed in the corner of the edge area of the organic light emitting panel 271.

Meanwhile, depending on the type of the replayed image, the position of the organic light emitting panel 271 in the vehicle, or the like, a difference between the center temperature and the edge temperature of the organic light emitting panel 271 may occur.

The processor 270 may calculate the average temperature of the center temperature of the organic light emitting panel 271 detected by the first temperature detecting unit 281*a*, and the edge temperatures detected by the second temperature detecting unit 281*b* to the fifth temperature detecting unit 281*e*. The average temperature of the organic light emitting panel 271 may be used for calculating a luminance reduction amount described later.

The touch input device included in the display unit 261 and the input unit 220 may have a mutual layer structure or may be integrally formed to implement a touch screen. The touch screen may serve as the input unit 220 that provides an input interface between the multimedia device 200 for vehicle and a user, while providing an output interface between the multimedia device 200 for vehicle and the user.

The display unit 261 may include a touch sensor for detecting a touch so that a control command can be received by a touch method. When a touch is accomplished for the display unit 261, the touch sensor detects the touch, and the processor 270 may generate a control command corresponding to the touch based on the detected touch. The content input by the touch method may be a character or a number, an instruction in various modes, or a menu item which can be designated.

The display unit 261 may be electrically connected to the processor 270 and controlled by the processor 270. The processor 270 may output the image of the content or the screen of the navigation through the display unit 261. The navigation is an application program for guiding a traveling route of the vehicle 100, and may include a screen showing a traveling route or a guidance voice.

The sound output unit 262 may output a sound corresponding to the electric signal provided by the processor 270. For this purpose, the sound output unit 142 may include a speaker or the like. The processor 270 may output the sound of the content or the guidance voice of the navigation through the sound output unit 262.

The sound output unit 262 may output the music content stored in the memory 230 or the music content received from the mobile terminal.

The sound output unit 262 may output a sound corresponding to various operations of the multimedia device 200 for vehicle.

The processor 270 may control the overall operation of each unit in the multimedia device 200 for vehicle. The processor 270 may be electrically connected to the communication unit 210, the input unit 220, the memory 230, the interface unit 250, the power supply unit 290, and the output unit 260.

The processor 270 may calculate the luminance reduction amount of the organic light emitting panel 271, on a block-by-block basis instead of a conventional pixel unit. To this end, the processor 270 may divide the organic light emitting panel 271 into a plurality of blocks, and divide the plurality of blocks into sub-blocks.

The processor 270 may calculate the luminance reduction amount per unit time of a plurality of sub-blocks, based on the gray level information and the temperature information of sub-block.

The processor 270 may calculate a time point of degradation compensation of the organic light emitting panel 271, based on the luminance reduction amount per unit time of sub-block. Meanwhile, the time point of degradation compensation may be referred to as a time point of aging compensation.

The time point of degradation compensation of the processor 270 will be described later in more detail with reference to FIG. 7 and below.

Figure 5:
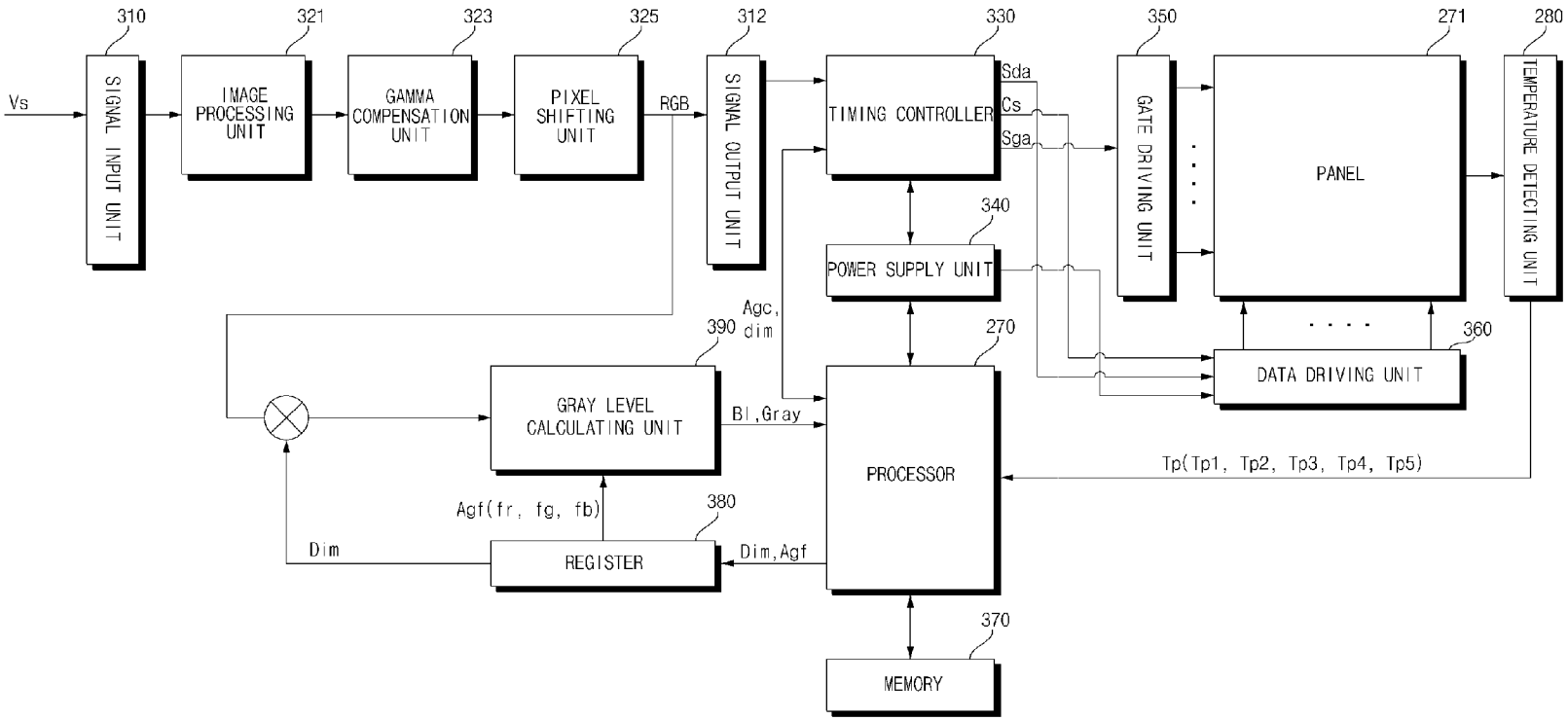
FIG. 5 is a block diagram for explaining a display unit of FIG. 3.

FIG. 5 is a block diagram for explaining a display unit of FIG. 3.

Referring to the drawing, the display apparatus 200 for vehicle may include an organic light emitting panel 271, a signal input unit 310, a signal output unit 312, an image processing unit 321, a gamma compensation unit 323, a pixel shifting unit 325, a timing controller 330, a gate driving unit 350, a data driving unit 360, a power supply unit 340, a temperature detecting unit 280, a processor 270, a memory 370, a gray level calculating unit 390, a register 380, and the like.

The display apparatus 200 for vehicle may output a certain image based on an image signal Vs. For example, the display apparatus 200 for vehicle may output a graphic object indicating the dashboard information of the vehicle 100 or various image contents, based on the image signal Vs.

The signal input unit 310 may receive the image signal Vs from the controller 170.

The image processing unit 321 may perform image processing of the image signal Vs. To this end, the image processing unit 321 may include an image decoder (not shown), a scaler (not shown), and a formatter (not shown).

According to an embodiment, the image processing unit 321 may further include a demultiplexer (not shown) for demultiplexing an input stream. The demultiplexer may separate the input stream into image, voice, and data signal. At this time, the image decoder (not shown) may decode the demultiplexed image signal Vs, and the scaler 335 may perform scaling for the resolution of the decoded image signal Vs so as to output to the organic light emitting panel 271.

According to an embodiment, the image processing unit 321 may further include a frame rate converter (FRC) (not shown) for converting a frame rate of an input image. Meanwhile, the frame rate converter may directly output without any frame rate conversion.

The formatter (not shown) may convert the format of the input image signal Vs into an image signal for display on the organic light emitting panel 271 and output the converted image signal.

Meanwhile, in the case of the organic light emitting panel 271, since the characteristics of the organic compounds constituting the RGB pixels of a sub-pixel are different, each sub-pixel may have different gamma characteristics.

The gamma compensation unit 323 may perform gamma correction for the image signal processed by the image processing unit 321. Accordingly, a signal width of the image signal may be varied.

The pixel shifting unit 325 may shift a pixel in a certain pattern with respect to a still image. Thus, the problem of after-image due to degradation of the organic light emitting panel 271 may be solved.

The signal output unit 312 may output the image signal (RGB signal) converted through the image processing unit 321, the gamma compensation unit 323, and the pixel shifting unit 325 to the timing controller 330.

The timing controller 330 may output a data driving signal Sda and a gate driving signal Sga, based on the converted image signal.

The timing controller 330 may further receive a control signal, a vertical synchronization signal Vsync, and the like, in addition to the image signal Vs from the controller 170.

In addition, the timing controller 330 may output a gate driving signal Sga for the operation of the gate driving unit 350, and a data driving signal Sda for the operation of the data driving unit 360, based on the control signal, the vertical synchronization signal Vsync, and the like, in addition to the image signal Vs.

Meanwhile, the timing controller 330 may further output a control signal Cs to the gate driving unit 350.

The gate driving unit 350 and the data driving unit 360 supply a scan signal and an image signal to the organic light emitting panel 271, through a gate line GL and a data line DL, according to the gate driving signal Sga and the data driving signal Sda from the timing controller 330. Accordingly, the organic light emitting panel 271 displays a certain image.

Meanwhile, the organic light emitting panel 271 may include an organic luminescent layer. In order to display an image, a plurality of gate lines GL and data lines DL may be disposed to be intersected with each other in a matrix form, in each pixel corresponding to the organic luminescent layer.

Meanwhile, the data driving unit 360 may output a data signal to the organic light emitting panel 271, based on the DC power supplied from the controller 170.

The power supply unit 340 may supply various powers to the gate driving unit 350, the data driving unit 360, the timing controller 330, and the like.

The temperature detecting unit 280 may be disposed on the rear surface of the organic light emitting panel 271 to detect the temperature of the organic light emitting panel 271.

The temperature detecting unit 280 may include a first temperature detecting unit 281*a* which is disposed in the center of the rear surface of the organic light emitting panel 271 and detects the center temperature the organic light emitting panel 271, a second temperature detecting unit 281*b*, a third temperature detecting unit 281*c*, a fourth temperature detecting unit 281*d*, and a fifth temperature detecting unit 281*e* which are disposed in the edge of the rear surface of the organic light emitting panel 271 and detect the temperature of the edge of the organic light emitting panel 271.

The first temperature detecting unit 281*a* may detect a first temperature which is a temperature of the center of the organic light emitting panel 271.

The second to fifth temperature detecting units 281*b* to 281*e* may detect the second to fifth temperatures (Tp2 to Tp5) which are the edge temperatures of the organic light emitting panel 271.

The first to fifth temperatures (Tp1 to Tp5) may be input to the processor 270 so as to calculate the average temperature.

The processor 270 may perform various controls in the display unit 261 for vehicle. For example, the processor 270 may control the gate driving unit 350, the data driving unit 360, the timing controller 330, and the like.

Meanwhile, the processor 270 may receive the temperature information of the organic light emitting panel 271 from the temperature detecting unit 280.

The processor 270 may calculate the average temperature of the organic light emitting panel 271 based on the temperature information of the organic light emitting panel 271. For example, the processor 270 may calculate a value obtained by dividing the sum of the first to fifth temperatures (Tp1 to Tp5) by 5 as the average temperature of the organic light emitting panel 271. The average temperature information may be stored in the memory 370.

The gray level calculating unit 390 may calculate the gray level of the organic light emitting panel 271.

Specifically, the gray level calculating unit 390 may receive a pixel-shifted RGB signal. The gray level calculating unit 390 may receive a luminance compensation value Dim of the organic light emitting panel 271 and an aging acceleration factor Agf from the processor 270.

At this time, the luminance compensation value Dim may be a luminance value of the organic light emitting panel compensated by the processor 270. For example, when the processor 270 reduces the total luminance of the organic light emitting panel 271 by 1% at the time of degradation compensation, the luminance compensation value Dim may be −1%.

In addition, the aging acceleration factor Agf may be a factor that reflects the luminance reduction amount per unit time calculated by the processor 270. Further, the aging acceleration factor Agf may be a value that reflects the degradation speed depending on the luminance reduction amount. For example, as the luminance reduction amount per unit time increases, the aging acceleration factor Agf may be increased.

The gray level calculating unit 390 may calculate the gray level of the organic light emitting panel 271, based on the pixel shifted RGB signal, the luminance compensation value dim, and the aging acceleration factor Agf.

The gray level calculating unit 390 may set the gray level in accordance with the current stress applied to the organic light emitting panel 271. For example, the gray level calculating unit 390 may be set to increase the gray level as the current stress applied to the organic light emitting panel 271 increases.

The gray level calculating unit 390 may divide the gray level into 1 to 16 levels. At this time, the level 16 is a full white image, and the level 1 may be a full black image.

The gray level calculating unit 390 may calculate the gray level of the block and the sub-block, and output the gray level to the processor 270. To this end, the gray level calculating unit 390 may include a selector (not shown), and output the number Bl of the block or the sub-block and the gray level (Gray) of a corresponding block or a corresponding sub-block, due to a selection signal of the processor 270.

The gray level calculating unit 390 may calculate the gray level of sub-block on a frame basis, and transmit the gray level to the processor 270.

Meanwhile, the memory 370 may store, in the form of a look-up table, the luminance reduction amount information of the organic light emitting panel 271 according to the temperature and gray level of the organic light emitting panel 271.

The processor 270 may calculate the luminance reduction amount per unit time for a plurality of sub-blocks, based on the gray level information of sub-block calculated by the gray level calculating unit 390 and the temperature information of the organic light emitting panel 271 detected by the temperature detecting unit 280.

In addition, the processor 270 may calculate the time point of the degradation compensation of the organic light emitting panel 271, based on the luminance reduction amount per unit time of the plurality of sub-blocks.

When the accumulated luminance reduction amount information of any one sub-block reaches a first accumulated luminance reduction amount, the processor 270 may calculate as the time point of the first degradation compensation of the organic luminescence panel 271 so that the luminescence of the organic luminescence panel 271 can be compensated.

When calculating as the time point of the first degradation compensation of the organic luminescence panel 271, the processor 270 may transmit the aging compensation command and a first luminance compensation value Dim1 to the timing controller 330 through a 12C interface. Accordingly, the total luminance of the organic light emitting panel 271 may be reduced as much as a preset luminance.

The processor 270 may initialize the time point of the first degradation compensation and the accumulated luminance reduction amount of sub-block, in a state in which the luminance of the organic light emitting panel 271 is compensated.

In addition, when the accumulated luminance reduction amount of any one sub-block reaches the first accumulated luminance reduction amount again after the time point of the initialized first degradation compensation, the processor 270 may calculate as the time point of the second degradation compensation.

When calculating as the time point of the second degradation compensation of the organic light emitting panel 271, the processor 270 may transmit the aging compensation command and the second luminance compensation value Dim1 to the timing controller 330 through the 12C interface. Accordingly, the total luminance of the organic light emitting panel 271 may be reduced as much as a preset luminance.

The processor 270 may perform the above mentioned luminance compensation control a preset number of times. The preset number of times may be set in consideration of the luminance reduction amount per unit time of the organic light emitting panel 271 and the accumulated luminance reduction amount at the time of burn-in of the organic light emitting panel 271. For example, when the luminance reduction amount per unit time of the organic light emitting panel 271 is 1%, and the accumulated luminance reduction amount at the time of burn-in of the organic light emitting panel 271 is 20%, the preset number of times may be 20.

When the accumulated luminance reduction amount of any one sub-block is equal to or greater than a second accumulated luminance reduction amount greater than the first accumulated luminance reduction amount, the processor 270 may calculate a corresponding sub-block as a burn-in sub-block. The second accumulated luminance reduction amount may be set in consideration of the accumulated luminance reduction amount at the time of burn-in of the organic light emitting panel 271. For example, when the accumulated luminance reduction amount at the time of burn-in of the organic light emitting panel 271 is 20%, the second accumulated luminance reduction amount may be 20%.

The degradation compensation of the processor 270 will be described in more detail with reference to FIG. 7 and below.

Figure 6A:
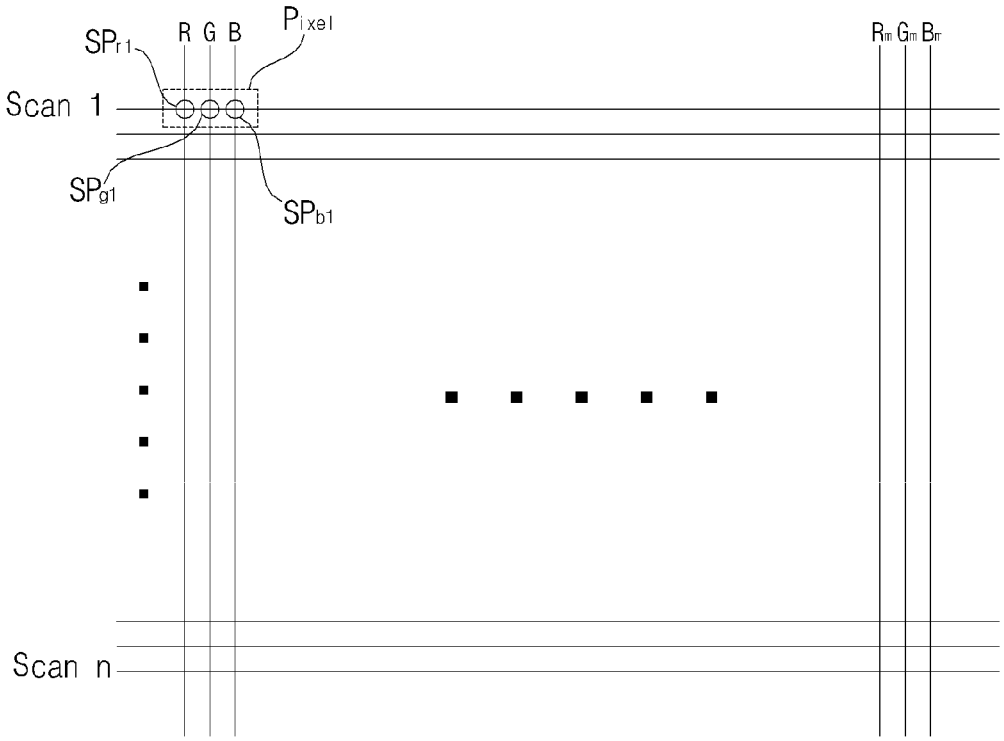
FIG. 6A and FIG. 6B are diagrams for explaining the organic light emitting panel of FIG. 5.
Figure 6B:
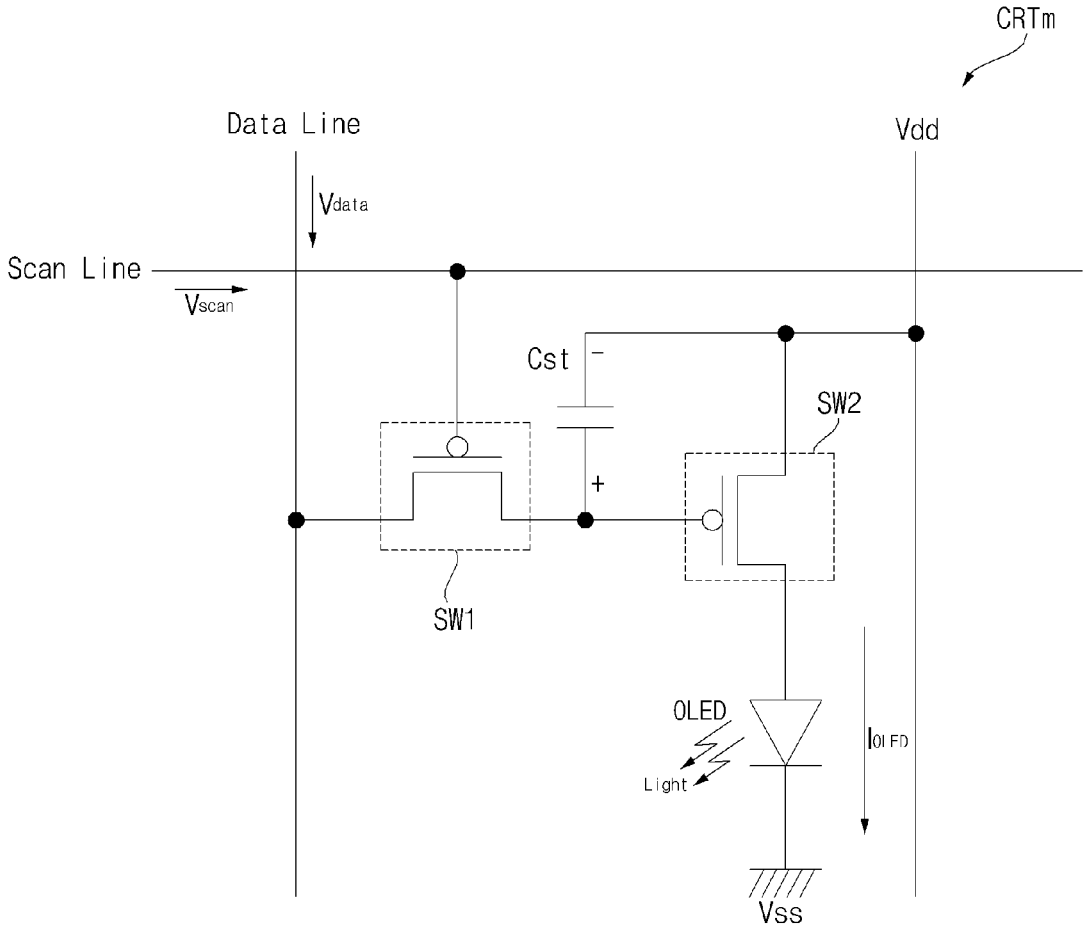

FIG. 6A and FIG. 6B are diagrams for explaining the organic light emitting panel of FIG. 5.

Firstly, FIG. 6A is a diagram showing a pixel in the organic light emitting panel 271.

Referring to the drawings, the organic light emitting panel 271 may include a plurality of scan lines (Scan 1 to Scan n) and a plurality of data lines (R1, G1, B1 to Rm, Gm, Bm) that intersect with the plurality of scan lines.

Meanwhile, a sub-pixel is defined in an intersection area of the scan line and the data line in the organic light emitting panel 271. Although a pixel having RGB sub-pixels (SR1, SG1, and SB1) is shown in the drawing, according to an embodiment, it is also possible that the pixel has RGBW sub-pixels.

FIG. 6B illustrates a circuit of any one sub-pixel in the pixel of the organic light emitting panel 271 of FIG. 6A Referring to the drawings, the organic light emitting sub-pixel circuit CRT is an active type, and may include a switching transistor SW1, a storage capacitor Cst, a driving transistor SW2, and an organic light emitting layer OLED.

The switching transistor SW1 is turned on according to an input scan signal Vdscan, as the scan line is connected to a gate terminal. When turned on, the input data signal Vdata is transmitted to the gate terminal of the driving transistor SW2 or one end of the storage capacitor Cst.

The storage capacitor Cst is formed between the gate terminal and the source terminal of the driving transistor SW2, and stores a certain difference between a data signal level transmitted to one end of the storage capacitor Cst and a level of the DC power (VDD) transmitted to the other end of the storage capacitor Cst.

For example, when the data signal has different levels according to a Pulse Amplitude Modulation (PAM) method, the power level stored in the storage capacitor Cst varies depending on a level difference of the data signal Vdata.

For another example, when the data signal has different pulse widths according to a Pulse Width Modulation (PWM) method, the power level stored in the storage capacitor Cst varies depending on a pulse width difference of the data signal Vdata.

The driving transistor SW2 is turned on according to the power level stored in the storage capacitor Cst. When the driving transistor SW2 is turned on, a driving current (IOLED), which is proportional to the stored power level, flows in the organic light emitting layer (OLED). Accordingly, the organic light emitting layer (OLED) performs a light emitting operation.

The organic light emitting layer OLED includes a light emitting layer (EML) of R, G, B corresponding to a sub-pixel, and may include at least one of a hole injection layer (HIL), a hole transport layer (HTL), an electron transport layer (ETL), and an electron injection layer (EIL). In addition, it may include a hole blocking layer, and the like.

Meanwhile, all of the sub-pixels output white light in the organic light emitting layer (OLED). However, in the case of green, red, and blue sub-pixels, a separate color filter is provided to implement a color. That is, in the case of green, red, and blue sub-pixels, green, red, and blue color filters are further provided, respectively. Meanwhile, in the case of a white sub-pixel, since a white light is outputted, a separate color filter is not required.

Meanwhile, in the drawing, it is illustrated that the switching transistor SW1 and the driving transistor SW2 are p-type MOSFET, but n-type MOSFET or a switching element such as JFETs, IGBTs, SICs, or the like is also available.

Meanwhile, the pixel is a hold-type element that continuously emits light in the organic light emitting layer (OLED), after a scan signal is applied, during a unit display period, specifically, a unit frame.

Meanwhile, each sub-pixel shown in FIG. 6B is degraded or aged as the current flows, so that a light output in a set current density is reduced.

In particular, since some sub-pixels are used more frequently than other sub-pixels, more frequently used pixels are more degraded than less frequently used pixels. Accordingly, a burnt in image may occur in the organic light emitting panel 271.

The present invention suggests a method that user can use the display apparatus 200 for vehicle without any discomfort, by compensating the luminance in an appropriate time of the organic light emitting panel 271.

Figure 7:
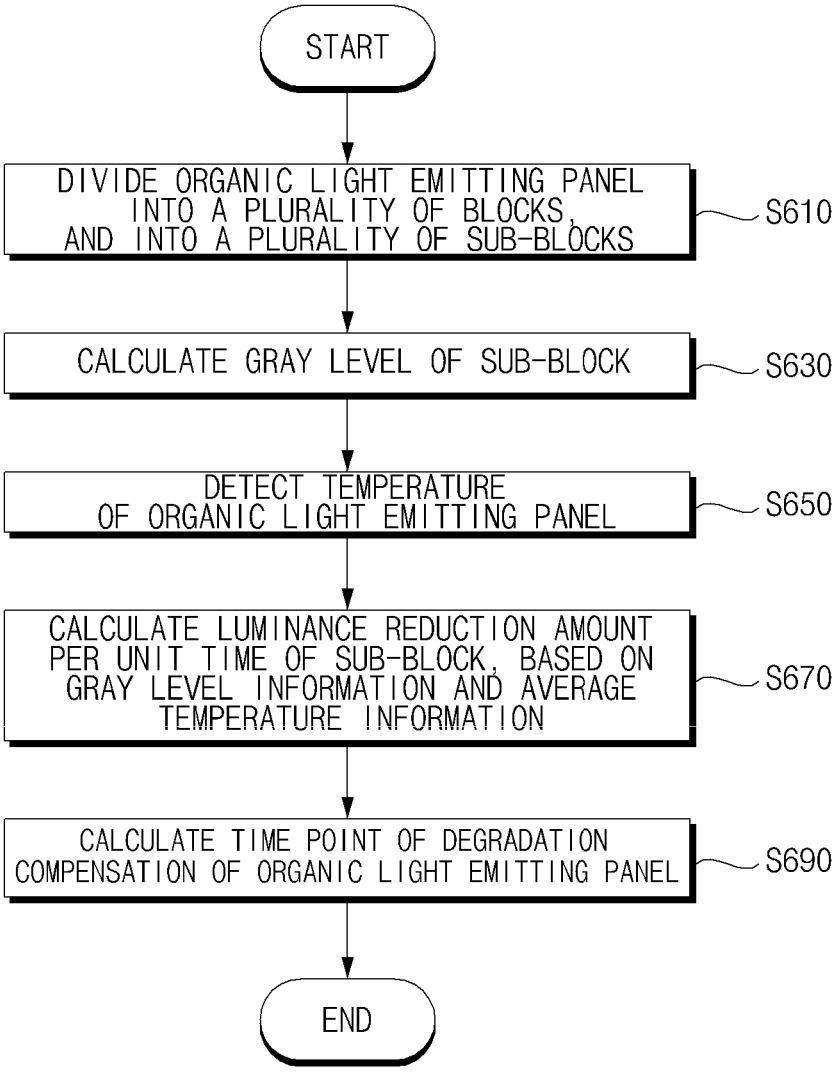
FIG. 7 is a flowchart showing an operation method of a display apparatus for vehicle according to an embodiment of the present invention.

FIG. 7 is a flowchart showing an operation method of a display apparatus for vehicle according to an embodiment of the present invention, and FIG. 8 to FIG. 12 are diagrams for explaining the operation method of FIG. 7.

Figure 8:
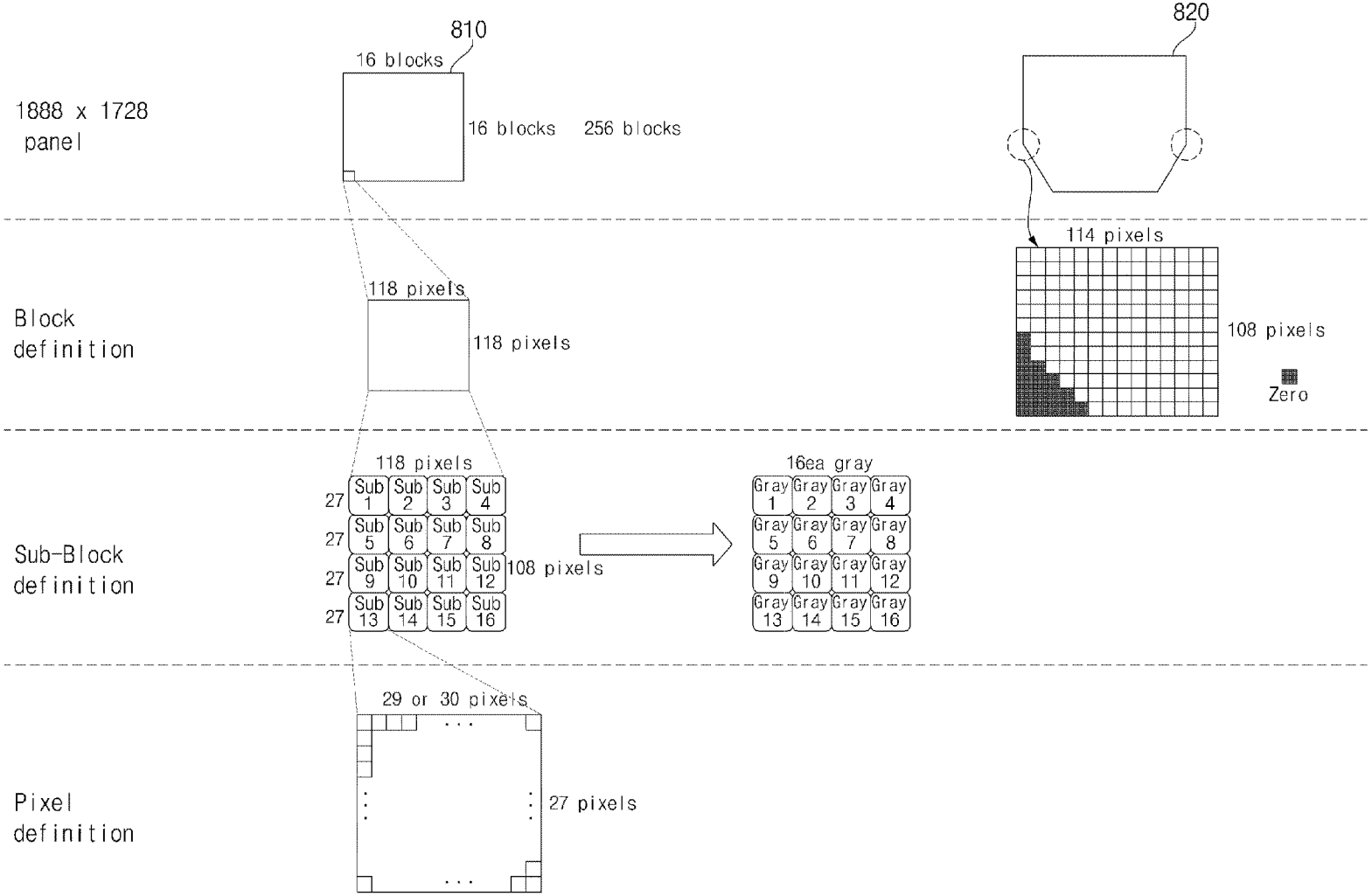
FIG. 8 is a diagram for explaining a method of dividing a block and a sub-block of an organic light emitting panel.
Figure 9:
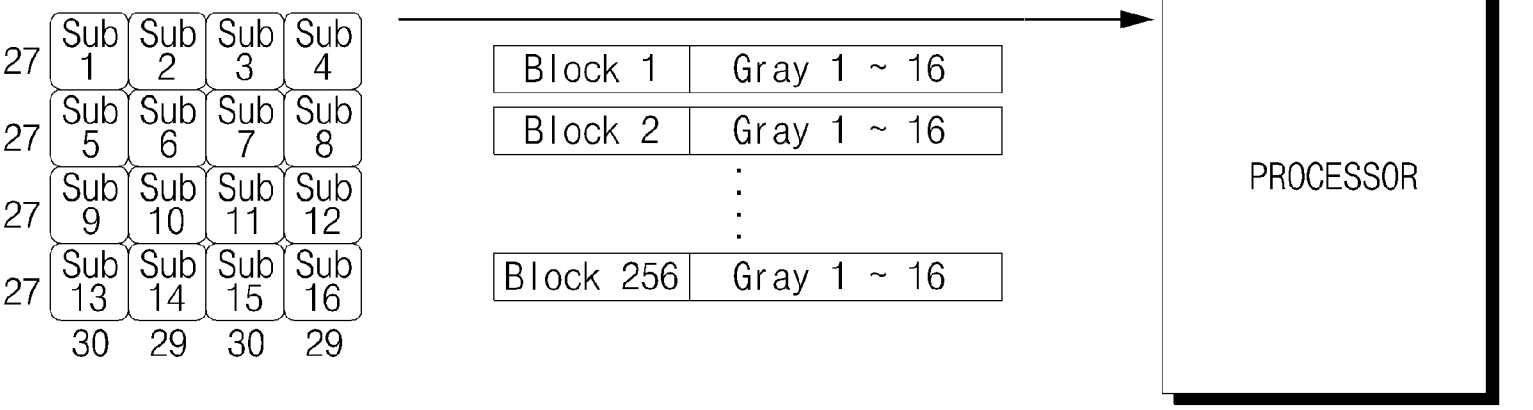
FIG. 9 and FIG. 10 are diagrams for explaining a gray level calculation method of a block and a sub-block.
Figure 10:
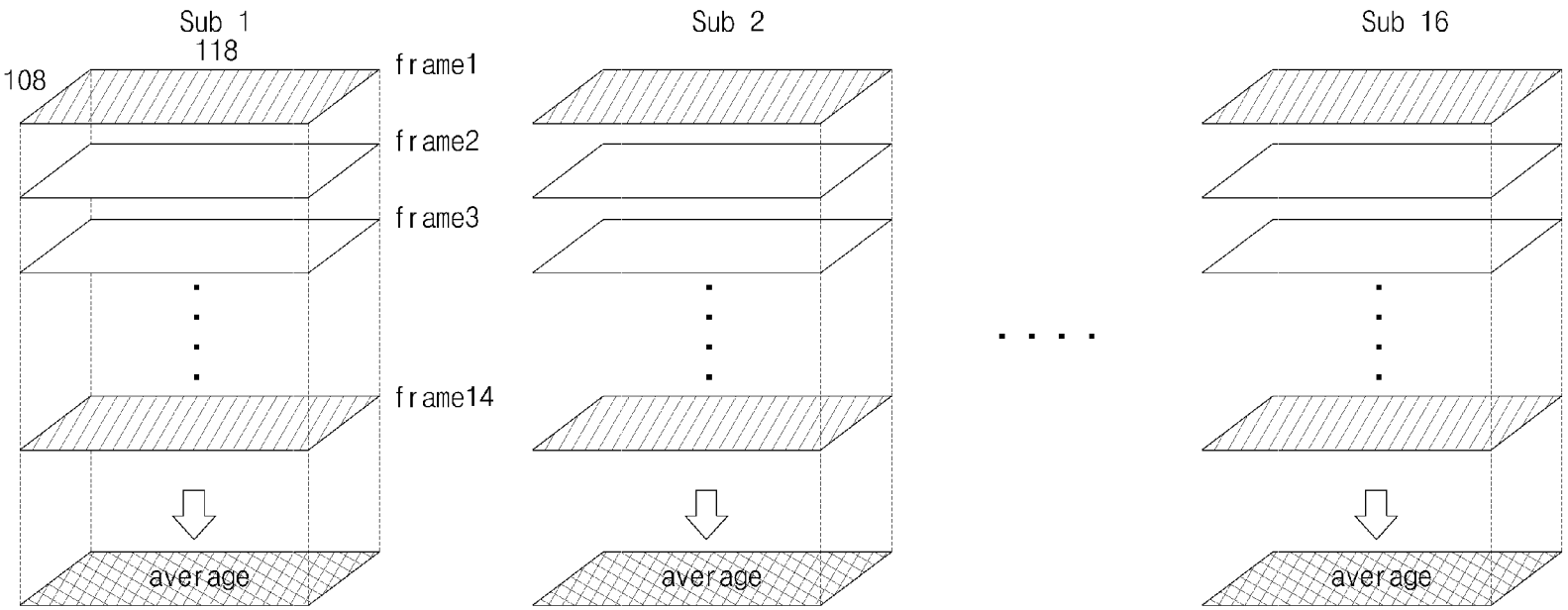
Figure 11A:
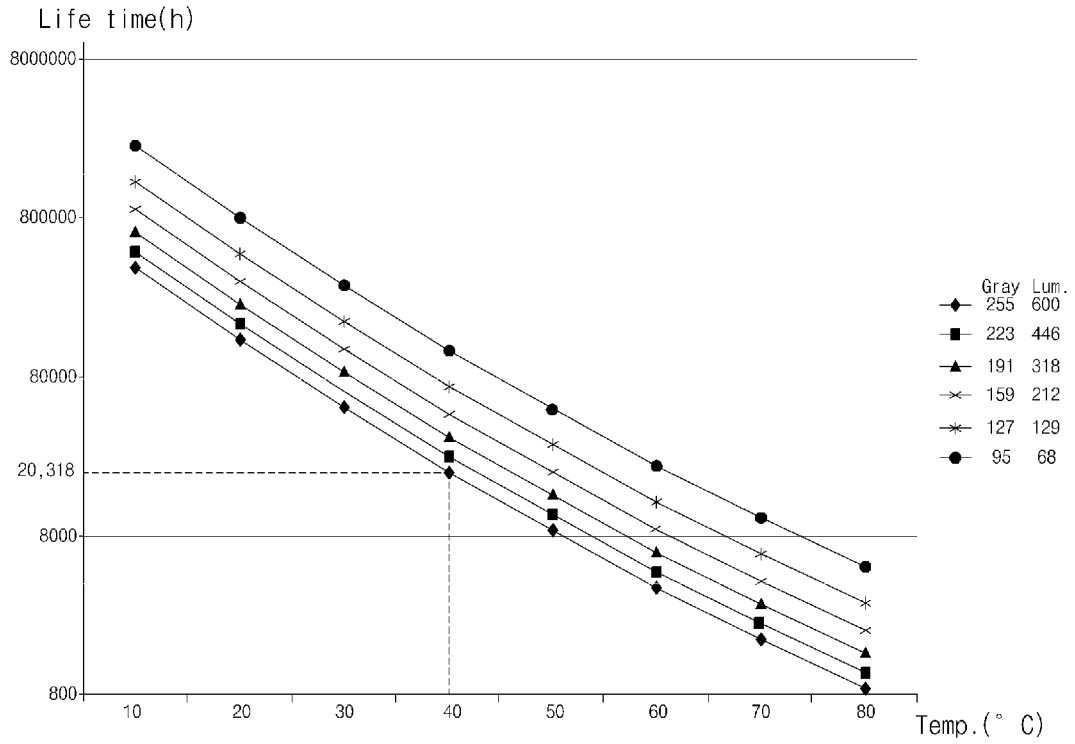
FIG. 11A to FIG. 11C are diagrams for explaining a gray level of organic light emitting panel and a luminance reduction amount of organic light emitting panel according to the temperature change.
Figure 11B:
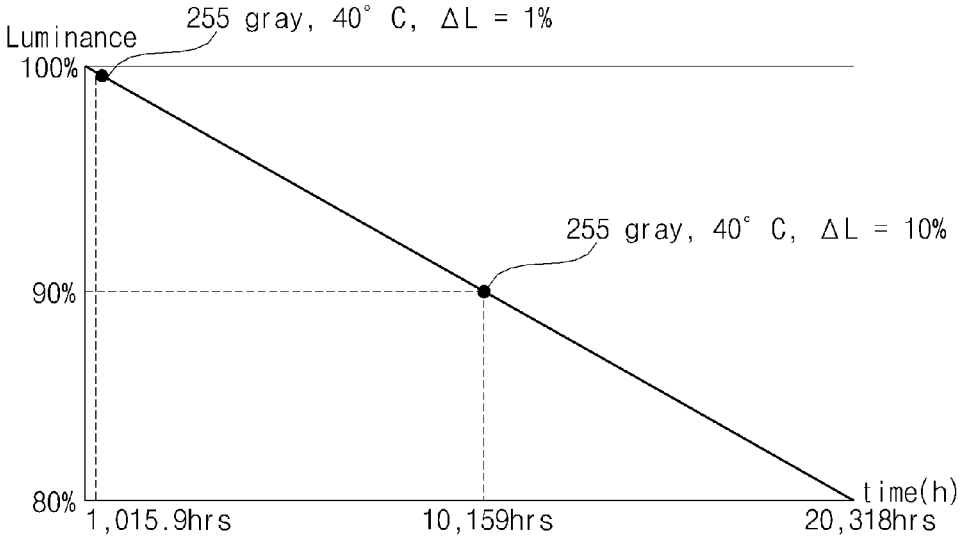
Figure 11C:
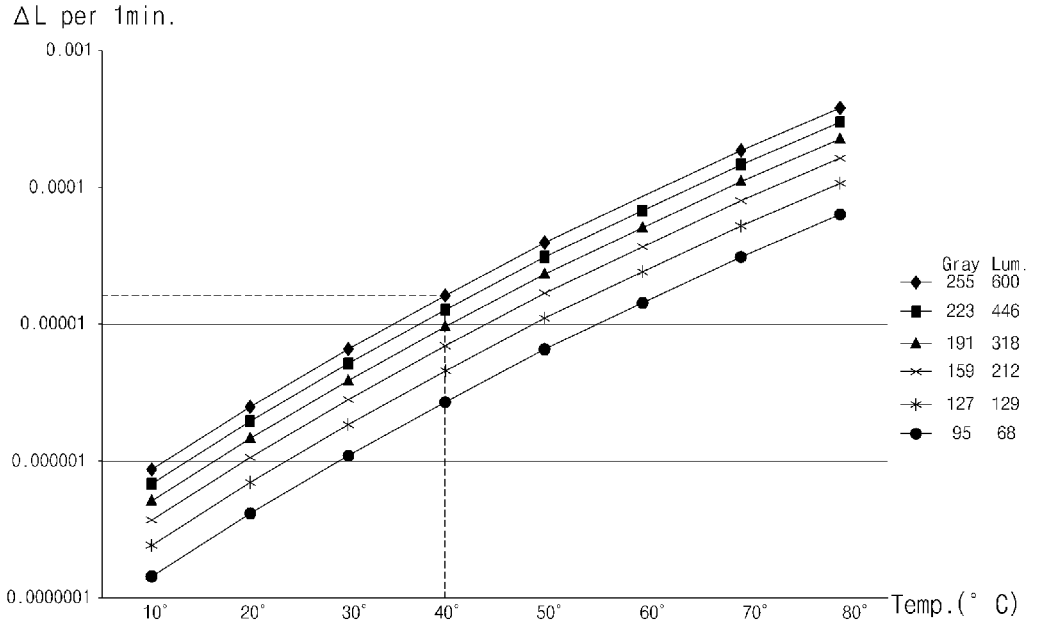
Figure 12:
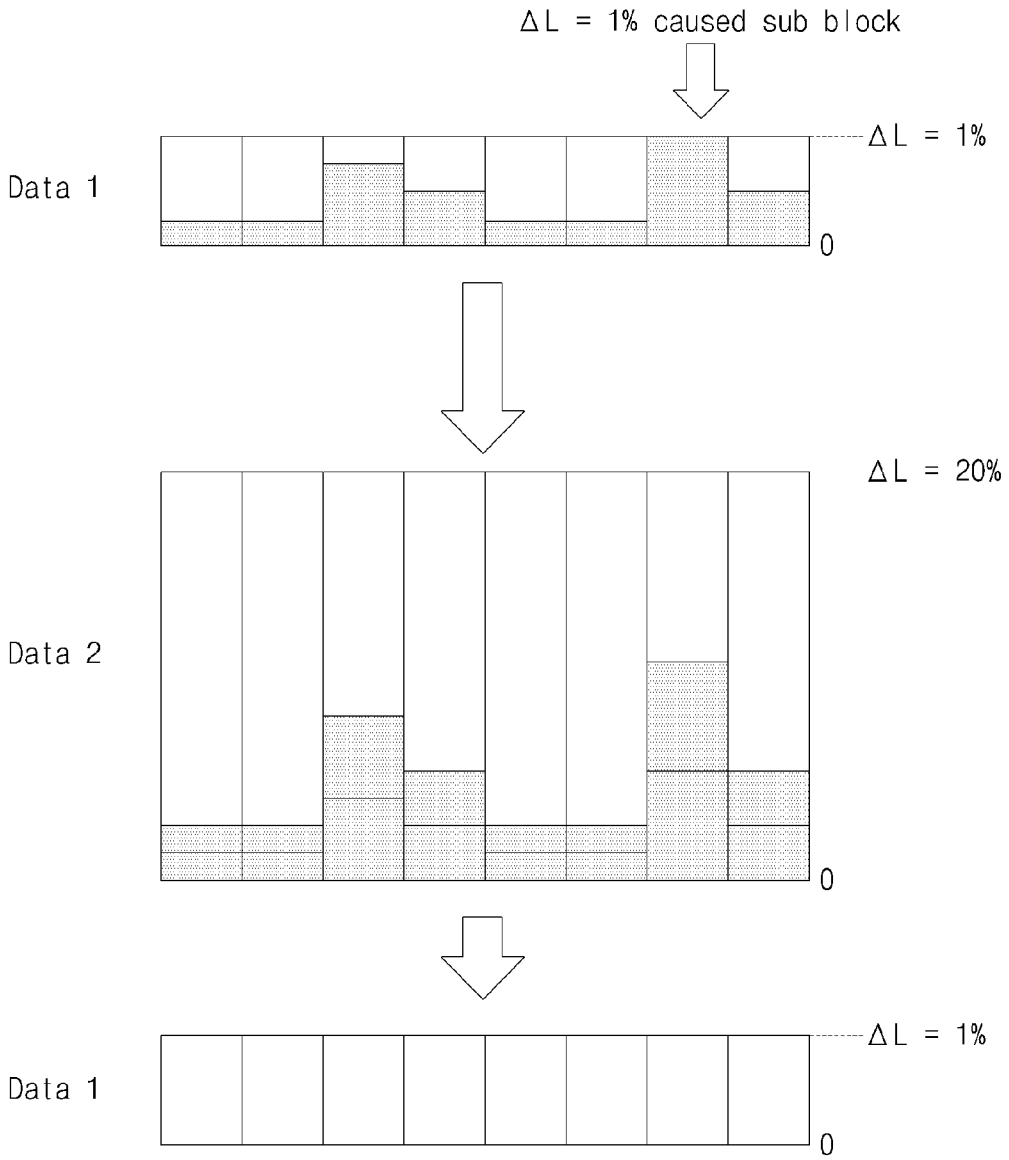
FIG. 12 is a diagram for explaining a method of storing the luminance reduction amount.

More specifically, FIG. 8 is a diagram for explaining a method of dividing a block and a sub-block of an organic light emitting panel, FIG. 9 and FIG. 10 are diagrams for explaining a gray level calculation method of a block and a sub-block, FIG. 11A to FIG. 11C are diagrams for explaining a gray level of organic light emitting panel and a luminance reduction amount of organic light emitting panel according to the temperature change, and FIG. 12 is a diagram for explaining a method of storing the luminance reduction amount.

Referring to the drawing, the processor 270 may divide the organic light emitting panel 271 into a plurality of blocks, and divide the plurality of blocks into a plurality of sub-blocks smaller than the plurality of blocks (S610).

The size of the block and the size of sub-block may be appropriately set in consideration of resolution and shape of the organic light emitting panel 271.

For example, when the resolution of the organic light emitting panel 271 is 1888*1728 as shown in 810 of FIG. 8, the processor 270 may divide the organic light emitting panel 271 into 16*16. At this time, 118*108 sub-pixels may be included in a single block.

In addition, the processor 270 may divide each of 256 blocks into 16 sub-blocks. In a single sub-block, 29 (or 30)*27 sub-pixels may be included.

As another example, when the organic light emitting panel 271 is a c-cut organic light emitting panel 271 as shown in 820 of FIG. 8, the processor 270 may recognize the c-cut portion of the organic light emitting panel 271 as '0'. By recognizing the c-cut portion as '0', the c-cut portion may be excluded when calculating the time point of the degradation compensation of the processor 270 described later.

Next, the gray level calculating unit 390 may calculate the gray level of sub-block (S630).

The gray level calculating unit 390 may calculate the gray level of sub-block, based on the pixel shifted RGB signal, the luminance compensation value dim, and the aging acceleration factor Agf. For example, the gray level of sub-block may be divided into levels 1 to 16.

As shown in FIG. 9, the gray level calculating unit 390 may transmit the gray level values of the plurality of sub-blocks to the processor 270. At this time, a gray level file may include a header for storing the block address, and data for storing the gray level value of sub-block.

The gray level calculating unit 390 may calculate the gray level of sub-block on a frame basis, and transmit to the processor 270. For example, when the number of sub-blocks is 16 and the number of frames replayed per unit time is 14, the gray level calculating unit 390 may transmit 224 gray level values per unit time to the processor 270.

The processor 270 may calculate the average gray level of sub-block by dividing the sum of the gray levels of sub-blocks calculated in a frame unit by the number of frames per unit time.

For example, as shown in FIG. 10, when the number of frames replayed per unit time is 14, the processor 270 may divide the sum of the gray levels calculated in each frame by 14 to calculate an average gray level. The processor may derive an average gray level of 16 sub-blocks per one block.

Meanwhile, as the gray level value becomes larger, the current stress of the organic light emitting panel 271 may be increased. Therefore, as the gray level value becomes larger, the luminance reduction amount due to degradation of the organic light emitting panel may be increased.

The gray level of sub-block may be used for calculating the luminance reduction amount of the organic light emitting panel 271.

Next, the temperature detecting unit 280 may detect the temperature of the organic light emitting panel 271 (S650).

Meanwhile, depending on the type of the replayed image, the position of the organic light emitting panel 271 in the vehicle, and the like, a difference between the center temperature and the edge temperature of the organic light emitting panel 271 may occur. For example, the center temperature and the edge temperature of the organic light emitting panel 271 may differ by maximum 5° C.

The processor 270 of the present invention may calculate an average temperature of the center temperature of the organic light emitting panel 271 and the edge temperature, and use the average temperature to calculate the luminance reduction amount of the organic light emitting panel 271.

To this end, the temperature detecting unit 280 may include a first temperature detecting unit 281*a* for detecting the center temperature of the organic light emitting panel 271, and second to fifth temperature detecting units 281*b* to 281*e* for detecting the edge temperature of the organic light emitting panel 271.

The processor 270 may calculate the average temperature of the organic light emitting panel 271 by dividing the sum of the temperatures of the first to fifth temperature detecting units 281*a* to 281*e* by five.

Next, the processor 270 may calculate the luminance reduction amount per unit time of sub-block, based on the average gray level of sub-block and the average temperature of the organic light emitting panel 271 (S670).

Specifically, the life time of the display apparatus 200 for vehicle according to the temperature of the organic light emitting panel 271 may be the same as shown in FIG. 11A. The life time may mean the case where the use of the display apparatus 200 for vehicle is inconvenient because of the burn-in phenomenon of the organic light emitting panel 271.

As shown in FIG. 11A, the life time of the display apparatus 200 for vehicle is reduced as the temperature of the organic light emitting panel 271 increases. Particularly, at the same temperature, as the gray level becomes larger, the life time of the organic light emitting panel 271 is decreased.

Meanwhile, in FIG. 11A, when the gray level is level 255, the luminance is 600, and the temperature of the organic light emitting panel 271 is 40 degrees, the life time of the display apparatus 200 for the vehicle may be 20,318 hours.

Under the above condition, the change in the luminance reduction according to time is the same as shown in FIG. 11B. In FIG. 11B, the time required for the luminance of the organic light emitting panel 271 to decrease by 1% is 1,015.9 hours, and the time required for the luminance of the organic light emitting panel 271 to decrease by 10% is 10,159 hours have.

That is, as shown in FIG. 11B, it can be seen that the luminance reduction amount decreases proportional to time under the condition of the same gray level and the same temperature.

As a result, the luminance reduction amount per unit time of sub-block according to the temperature of the organic light emitting panel 271 may be expressed as shown in FIG. 11C.

Meanwhile, the memory 370 may store the information of FIG. 11C in the form of a look-up table. That is, the memory 370 may store the luminance reduction amount information of the organic light emitting panel 271 according to the temperature and gray level of the organic light emitting panel 271 in the form of a look-up table.

The processor 270 may compare the average gray level of sub-block received from the gray level calculating unit 390 and the average temperature of the organic light emitting panel 271 received from the temperature detecting unit 280 with a look-up table stored in the memory 370 to calculate the luminance reduction amount per unit time of sub-block.

Next, the processor 270 may calculate the time point of degradation compensation of the organic light emitting panel 271, based on the luminance reduction amount of sub-block (S690).

The processor 270 may multiply the luminance reduction amount per unit time of sub-block by the use time of the display apparatus 200 for vehicle to calculate the accumulated luminance reduction amount of sub-block.

When the accumulated luminance reduction amount of any one block reaches the first accumulated luminance reduction amount, the processor 270 may calculate as a time point of first degradation compensation of the organic luminescence panel 271. For example, the first accumulated luminance reduction amount may be 1%.

Meanwhile, as shown in FIG. 12, the memory 370 may store first data which is information on luminance reduction amount per unit time of each of a plurality of sub-blocks and second data which is information on accumulated luminance reduction amount of each of a plurality of sub-blocks.

When calculating as the time point of first degradation compensation, the processor 270 may determine a corresponding sub-block as a burn-in estimated sub-block and compensate the luminance of the organic light-emitting panel 271.

For example, the processor 270 may reduce the total luminance of the organic light emitting panel 271 as much as a preset luminance. At this time, the preset luminance may be equal to the magnitude of the first accumulated luminance reduction amount. That is, when the first accumulated luminance reduction amount is 1%, the preset luminance may also be 1%. Accordingly, the luminance non-uniformity of the organic light emitting panel 271 may be reduced.

The processor 270 may initialize the time point of first degradation compensation and the accumulated luminance reduction amount of sub-block in a state in which the luminance of the organic light emitting panel 271 is compensated.

When any one sub-block, among blocks, reaches the first accumulated luminance reduction amount and compensates the luminance of the organic light emitting panel 271 as shown in FIG. 12, the processor 270 may control the memory 370 to initialize the first data. However, the processor 270 does not initialize the second data.

After the time point of first degradation compensation, at which initialization is achieved, when the accumulated luminance reduction amount of any one sub-block, among blocks, reaches again the first accumulated luminance reduction amount, the processor 270 may calculate as a time point of second degradation compensation to compensate the luminance of the organic light emitting panel 271.

The processor 270 may perform the luminance compensation of the organic light emitting panel 271 a preset number of times. For example, when the first accumulated luminance reduction amount is 1% and a second accumulated luminance reduction amount described later is 20%, the processor 270 may perform the luminance compensation of the organic light emitting panel 271 20 times.

When the accumulated luminance reduction amount of any one sub-block, among blocks, reaches the second accumulated luminance reduction amount larger than the first accumulated luminance reduction amount, the processor 270 may calculate a corresponding sub-block as a burn-in sub-block. At this time, the second data stored in the memory 370 may be used.

For example, when the first accumulated luminance reduction amount is 1%, the second accumulated luminance reduction amount is 20%, and the accumulated luminance reduction amount of any one sub-block reaches 20%, the processor 270 may calculate a corresponding sub-block as a burn-in sub-block.

When the accumulated luminance reduction amount of any one sub-block, among blocks, reaches the second accumulated luminance reduction amount, the processor 270 may limit the maximum luminance of the organic light emitting panel. For example, the processor 270 may limit the maximum luminance of the organic light emitting panel 271 to 70%. Thus, the life time of the organic light emitting panel 271 may be extended.

Meanwhile, the first accumulated luminance reduction amount and the second accumulated luminance reduction amount may be appropriately set so as not to be inconvenient for a driver to watch. For example, when the driver feels the inconvenience of viewing with respect to the luminance reduction amount of the organic light emitting panel 271 exceeding 1%, the first accumulated luminance reduction amount may be set to 1%.

As described above, since the display apparatus 200 for vehicular according to an embodiment of the present invention estimates the burn-in phenomenon, on a block basis or sub-block basis, there is an advantage that the calculation speed is improved and the capacity of the memory is reduced, in comparison with the case of estimating the burn-in phenomenon in a conventional pixel unit.

In addition, the display apparatus 200 for vehicle according to an embodiment of the present invention estimates the burn-in phenomenon in consideration of the temperature of the organic light emitting panel 271 as well as the gray level of sub-blocks, thereby enabling to achieve more accurate estimation.

In addition, the conventional degradation compensation compensates the luminance of the organic light emitting panel 271 in a fixed time period, which has a problem that image quality may be lowered before luminance compensation. However, the present invention compensates the luminance of the organic light emitting panel 271 not in a fixed time period, but compensates the luminance of the organic light emitting panel 271 in consideration of the luminance reduction amount of the organic light emitting panel 271, so that the uniformity of the image quality may be maintained.

The method of operating the display apparatus 200 for vehicle of the present invention may be implemented as a code that may be read by a processor on a processor-readable recording medium provided in the display apparatus 200 for vehicle. The processor-readable recording medium includes all kinds of recording apparatuses in which data that may be read by the processor is stored. Examples of the recording medium readable by the processor include a ROM, a RAM, a CD-ROM, a magnetic tape, a floppy disk, an optical data storage device, and the like, and may also be implemented in the form of a carrier wave such as transmission over the Internet. In addition, the processor-readable recording medium may be distributed over network-connected computer systems so that code readable by the processor in a distributed fashion may be stored and executed.

The display apparatus for vehicle according to an embodiment of the present invention calculates the time point of the degradation compensation in consideration of not only the gray level of the organic light emitting panel but also the temperature of the organic light emitting panel, so that the time point of occurrence of the burn-in phenomenon can be derived more accurately.

In addition, the display apparatus for vehicle divides the organic light emitting panel into blocks and calculates the gray level on a block-by-block basis. Therefore, the gray level calculation speed is improved and the memory capacity is reduced in comparison with a conventional case of calculating the gray level on a pixel-by-pixel basis.

Further, the display apparatus for vehicle does not calculate the luminance reduction amount on a frame-by-frame basis, but calculates the luminance reduction amount based on the average gray level of frames reproduced in a unit time, so that the calculation speed at the time point of degradation compensation is further improved.

In addition, the display apparatus for vehicle can calculate the time point of degradation compensation of the organic light emitting panel more accurately by calculating the luminance reduction amount of the organic light emitting panel in consideration of the temperature of the edge part as well as the temperature of the center part of the organic light emitting panel.

In addition, the display apparatus for vehicle can detect the burn-in occurrence sub-block by accumulating and storing the luminance reduction amount of sub-block.

Further, when the time point of degradation compensation is calculated, the display apparatus for vehicle can minimize the luminance non-uniformity between blocks or between sub-blocks, through luminance compensation of the organic light emitting panel.

In addition, the display apparatus for vehicle can maintain the initial quality of the apparatus by minimizing the luminance non-uniformity, thereby improving user reliability.

In addition, in the display apparatus for vehicle, when the accumulated luminance reduction amount of any one sub-block, among blocks, is equal to or greater than a preset accumulated luminance reduction amount, the maximum luminance of the organic light emitting panel can be limited to extend the entire life time of the display apparatus for vehicle Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

What is claimed is:

1. A display apparatus for a vehicle comprising:
- an organic light emitting panel;
- a gray level calculator configured to calculate a gray level of the organic light emitting panel;
- a temperature sensor configured to sense a temperature of the organic light emitting panel; and
- a processor configured to:
  - divide the organic light emitting panel into a plurality of blocks,
  - divide at least one of the plurality of blocks into a plurality of sub-blocks that are smaller than the at least one of the plurality of blocks,
  - calculate a luminance reduction amount per unit time of the plurality of sub-blocks based on gray level information calculated by the gray level calculator and temperature information of the organic light emitting panel sensed by the temperature sensor, and
  - calculate a time point of degradation compensation of the organic light emitting panel based on the luminance reduction amount per unit time of the plurality of sub-blocks.

2. The display apparatus of claim 1, wherein the gray level calculator is configured to calculate the gray level information in frame units, and transmit the calculated gray level information to the processor.

3. The display apparatus of claim 1, wherein the processor is configured to:
- calculate an average gray level of the plurality of sub-blocks by dividing a sum of gray levels of the plurality of sub-blocks, which are calculated in frame units, by a number of frames per unit time, and
- calculate the luminance reduction amount per unit time of the plurality of sub-blocks based on the average gray level and the temperature information.

4. The display apparatus of claim 1, wherein the temperature sensor comprises:
- a first temperature sensor configured to sense a center temperature of the organic light emitting panel; and
- second to fifth temperature sensors configured to sense respective edge temperatures of the organic light emitting display panel.

5. The display apparatus of claim 4, wherein the processor is configured to:
- calculate an average temperature of the center temperature of the organic light emitting panel sensed by the first temperature sensor and the edge temperatures detected by the second to fifth temperature sensors, and
- calculate the luminance reduction amount per unit time of the organic light emitting panel based on the average temperature and the gray level information.

6. The display apparatus of claim 1, wherein the processor is configured to calculate a time point of first degradation compensation of the organic light emitting panel based on an accumulated luminance reduction amount of any sub-block of the plurality of sub-blocks reaches a first accumulated luminance reduction amount.

7. The display apparatus of claim 6, wherein the processor is configured to:

initialize the time point of first degradation compensation and the accumulated luminance reduction amount in a state in which the luminance of the organic light emitting panel is compensated, and calculate a time point of second degradation compensation of the organic light emitting panel based on an accumulated luminance reduction amount of any sub-block of the plurality of sub-blocks reaching the first accumulated luminance reduction amount, after the initialization of the time point of first degradation compensation.

8. The display apparatus of claim 7, wherein the processor is configured to perform a luminance compensation of the organic light emitting panel a preset number of times.

9. The display apparatus of claim 6, wherein the processor is configured to determine a particular sub-block as a burn-in estimation sub-block based on an accumulated luminance reduction amount of the particular sub-block of the plurality of sub-blocks reaching the first accumulated luminance reduction amount.

10. The display apparatus of claim 6, wherein the processor is configured to determine a particular sub-block as a burn-in estimation sub-block based on an accumulated luminance reduction amount of the particular sub-block of the plurality of sub-blocks reaching a second accumulated luminance reduction amount larger than the first accumulated luminance reduction amount.

11. The display apparatus of claim 10, wherein the processor is configured to limit a maximum luminance of the organic light emitting panel based on an accumulated luminance reduction amount of any sub-block of the plurality of sub-blocks reaching the second accumulated luminance reduction amount.

12. The display apparatus of claim 6, wherein the processor is configured to reduce a total luminance of the organic light emitting panel as much as a preset luminance based on calculating the time point of first degradation compensation of the organic light emitting panel.

13. The display apparatus of claim 12, wherein the preset luminance is equal to a magnitude of the first accumulated luminance reduction amount.

14. The display apparatus of claim 1, further comprising a memory configured to store luminance reduction amount information per unit time of each of the plurality of sub-blocks, and accumulated luminance reduction amount information of each of the plurality of sub-blocks.

15. The display apparatus of claim 14, wherein the processor is configured to control the memory to initialize storage of the luminance reduction amount information based on calculation of the time point of degradation compensation.

16. The display apparatus of claim 1, further comprising a memory configured to store luminance reduction amount information per unit time of each of the plurality of sub-blocks.

17. The display apparatus of claim 16, wherein the processor is configured to control the memory to initialize storage of the luminance reduction amount information based on calculation of the time point of degradation compensation.

18. The display apparatus of claim 1, further comprising a memory configured to store accumulated luminance reduction amount information of each of the plurality of sub-blocks.

19. The display apparatus of claim 1, wherein the processor is configured to divide each of the plurality of blocks into the plurality of sub-blocks that are smaller than the plurality of blocks.

20. The display apparatus of claim 6, wherein the processor is configured to limit a maximum luminance of the organic light emitting panel based on an accumulated luminance reduction amount of any sub-block of the plurality of sub-blocks reaching a second accumulated luminance reduction amount larger than the first accumulated luminance reduction amount.

* * * * *